US010102803B2

(12) United States Patent
Park et al.

(10) Patent No.: US 10,102,803 B2
(45) Date of Patent: Oct. 16, 2018

(54) DISPLAY APPARATUS AND METHOD OF DRIVING THE SAME

(71) Applicant: Samsung Display Co., Ltd., Yongin-Si, Gyeonggi-Do (KR)

(72) Inventors: Jun-Hyun Park, Suwon-si (KR); An-Su Lee, Seoul (KR); Bo-Yong Chung, Suwon-si (KR); Chong-Chul Chai, Seoul (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 15/645,567

(22) Filed: Jul. 10, 2017

(65) Prior Publication Data

US 2018/0166010 A1 Jun. 14, 2018

(30) Foreign Application Priority Data

Dec. 13, 2016 (KR) ..... 10-2016-0169615

(51) Int. Cl.
*G09G 3/00* (2006.01)
*G09G 3/3233* (2016.01)
(Continued)

(52) U.S. Cl.
CPC ..... *G09G 3/3233* (2013.01); *G09G 3/3266* (2013.01); *G09G 3/3275* (2013.01);
(Continued)

(58) Field of Classification Search
CPC ..... G09G 3/3233; G09G 2300/0426; G09G 2320/0209; G09G 2320/0233; G09G 3/3266; G09G 2330/02; G09G 3/3275
See application file for complete search history.

(56) References Cited

U.S. PATENT DOCUMENTS

2006/0022305 A1* 2/2006 Yamashita ..... G09G 3/2014 257/565
2012/0249615 A1* 10/2012 Lee ..... G09G 3/003 345/691

(Continued)

FOREIGN PATENT DOCUMENTS

KR 2010-0009219 A 1/2010
KR 101182238 A 9/2012
KR 2016-0088484 A 7/2016

*Primary Examiner* — Muhammad N Edun
(74) *Attorney, Agent, or Firm* — Innovation Counsel LLP

(57) ABSTRACT

A display apparatus includes a plurality of pixels. Each pixel includes a first capacitor connected between a first voltage line receiving a driving signal and a first node; a first transistor comprising a control electrode connected to the first node, a first electrode connected to a second voltage line receiving a first power source signal, and a second electrode connected to a second node; an organic light emitting diode comprising an anode electrode connected to the second node and a cathode electrode receiving a second power source signal; a second capacitor connected between an m-th data line and the second node; a second transistor comprising a control electrode connected to an n-th gate line, a first electrode connected to the first node, and a second electrode connected to the second node;

and a third transistor comprising a control electrode connected to an n-th scan line, a first electrode connected to the first voltage line, and a second electrode connected to the second node.

20 Claims, 19 Drawing Sheets

(51) Int. Cl.
*G09G 3/3266* (2016.01)
*G09G 3/3275* (2016.01)

(52) U.S. Cl.
CPC ..... *G09G 2300/0426* (2013.01); *G09G 2320/0209* (2013.01); *G09G 2320/0233* (2013.01); *G09G 2330/02* (2013.01)

(56) References Cited

U.S. PATENT DOCUMENTS

| | | | | |
|---|---|---|---|---|
| 2014/0062978 | A1* | 3/2014 | Shin ..... | G09G 3/3291 345/204 |
| 2016/0267839 | A1 | 9/2016 | Yang | |
| 2016/0275869 | A1 | 9/2016 | Hwang et al. | |

* cited by examiner

DISPLAY APPARATUS AND METHOD OF DRIVING THE SAME

This application claims priority from and the benefit of Korean Patent Application No. 10-2016-0169615 filed on Dec. 13, 2016, which is hereby incorporated by reference in its entirety.

BACKGROUND OF THE INVENTION

1. Field of the Invention

Exemplary embodiments of the present disclosure relate to a display apparatus and a method of driving the display apparatus. More particularly, example embodiments of the present disclosure relate to a display apparatus for improving a display quality and a method of driving the display apparatus.

2. Description of the Related Art

Recently, various flat panel display devices that have weight and size advantages over conventional display devices such as Cathode Ray Tube (CRT) have been developed. Examples of the flat panel display devices include a liquid crystal display (LCD) device, a field emission display (FED) device, a plasma display panel (PDP), and an organic light emitting display (OLED) device.

The OLED device has advantages such as a rapid response speed and low power consumption because the OLED device uses an organic light emitting diode that emits a light based on recombination of electrons and holes.

BRIEF SUMMARY OF THE INVENTION

Exemplary embodiments of the inventive concept provide a display apparatus for improving a display quality.

Exemplary embodiments of the inventive concept provide a method of driving the display apparatus.

According to an exemplary embodiment of the inventive concept, a display apparatus includes a gate driver, a scan driver, and a display part including a plurality of pixel. Each pixel includes a first capacitor connected between a first voltage line receiving a driving signal and a first node; a first transistor comprising a control electrode connected to the first node, a first electrode connected to a second voltage line receiving a first power source signal. and a second electrode connected to a second node; an organic light emitting diode comprising an anode electrode connected to the second node and a cathode electrode receiving a second power source signal; a second capacitor connected between an m-th data line and the second node; a second transistor comprising a control electrode connected to an n-th gate line, a first electrode connected to the first node, and a second electrode connected to the second node; and a third transistor comprising a control electrode connected to an n-th scan line, a first electrode connected to the first voltage line, and a second electrode connected to the second node. The gate driver is configured to provide a plurality of gate lines in the display part with a gate signal including a first level voltage and a second level voltage, and the gate driver is configured to provide the n-th gate line with the first level voltage of the gate signal during an n-th horizontal period of a frame; The scan driver is configured to provide a plurality of scan lines in the display part with a scan signal including a first level voltage and a second level voltage, and the scan driver is configured to provide the n-th scan line with the first level voltage of the scan signal during a first reset period of the frame prior to the n-th horizontal period of the frame.

In an exemplary embodiment, during a first period of the frame, the first voltage line may be configured to receive a second level voltage of the driving signal, the second voltage line may be configured to receive a first level voltage of the first power source signal, the plurality of gate lines may be configured to receive the first level voltage of the gate signal turning on the second transistor of the plurality of pixels, simultaneously, and the plurality of scan lines may be configured to receive the first level voltage of the scan signal turning on the third transistor of the plurality of pixels, simultaneously.

In an exemplary embodiment, during a second period of the frame, the first voltage line may be configured to receive the second level voltage of the driving signal during an early part of the second period and to receive a reset voltage that is different from the second level voltage of the driving signal during a latter part of the second period, the second voltage line may be configured to receive a second level voltage of the first power source signal, the plurality of gate lines may be configured to receive the first level voltage of the gate signal turning on the second transistor of the plurality of pixels, simultaneously, and the plurality of scan lines is configured to receive the second level voltage of the scan signal turning off the third transistor of the plurality of pixels, simultaneously.

In an exemplary embodiment, the second level voltage of the first power source signal may be lower than the second level voltage of the driving signal.

In an exemplary embodiment, a third period of the frame may include the first reset period in which the first voltage line is configured to receive the reset voltage, the n-th scan line is configured to receive the first level voltage of the scan signal, and the n-th gate line is configured to receive the second level voltage of the gate signal turning off the second transistor.

In an exemplary embodiment, the first reset period may include at least one horizontal period.

In an exemplary embodiment, the third period of the frame may include a first holding period prior to the first reset period in which the first voltage line is configured to receive the reset voltage, the n-th scan line is configured to receive the second level voltage of the scan signal and the n-th gate line is configured to receive the second level voltage of the gate signal.

In an exemplary embodiment, the third period of the frame may further include a writing period corresponding to the n-th horizontal period after the first reset period in which the first voltage line is configured to receive the reset voltage, the n-th scan line is configured to receive the second level voltage of the scan signal, the n-th gate line is configured to receive the first level voltage of the gate signal, and the m-th data line is configured to receive a data voltage.

In an exemplary embodiment, during the n-th horizontal period, the first and second capacitors may be connected to each other in series, the data voltage may be divided by the first and second capacitors, and a divided data voltage may be applied to the first node.

In an exemplary embodiment, the third period of the frame may further include a second holding period placed after the writing period in which the first voltage line is configured to receive the reset voltage, the n-th scan line is configured to receive the second level voltage of the scan signal and the n-th gate line is configured to receive the second level voltage of the gate signal.

In an exemplary embodiment, during the third period, the second voltage line may be configured to receive the first level voltage of the first power source signal.

In an exemplary embodiment, during a fourth period of the frame, the first voltage line may be configured to receive a first level voltage of the driving signal that is higher than the second level voltage of the driving signal, the second voltage line may be configured to receive the first level voltage of the first power source signal, the plurality of gate lines may be configured to receive the second level voltage of the gate signal, simultaneously, and the plurality of scan lines may be configured to receive the second level voltage of the scan signal, simultaneously, and wherein the first transistor may be turned on by a difference voltage between the first and second level voltages of the driving signal, and a driving current corresponding to a data voltage applied to the first node may flow in the organic light emitting diode.

In an exemplary embodiment, the frame may further include a second reset period placed between the second holding period and the fourth period in which the first voltage line is configured to receive the reset voltage, the plurality of scan lines corresponding to a plurality of horizontal lines is configured to receive the first level voltage of the scan signal, simultaneously, and the plurality of gate signals may be configured to receive the second level voltage of the gate signal, simultaneously.

In an exemplary embodiment, during the third period of the frame, the second voltage line may be configured to receive a middle voltage between the first and second level voltages of the first power source signal.

According to an exemplary embodiment of the present disclosure, a method of driving a display apparatus that includes a pixel circuit driving an organic light emitting diode includes applying a second level voltage of a driving signal to a first voltage line to initialize an anode electrode of the organic light emitting diode that is connected to a second electrode of a first transistor, applying a second level voltage of a first power source signal to a first electrode of the first transistor to render the first transistor to be diode-connected, resetting the anode electrode of the organic light emitting diode using a reset voltage applied to the first voltage line during at least one horizontal period prior to an n-th horizontal period, applying a data voltage divided by a first capacitor and a second capacitor to a control electrode of the first transistor during the n-th horizontal period, and driving the organic light emitting diode to emit light based on the data voltage applied to the control electrode of the first transistor in response to a first level voltage of the driving signal applied to the first voltage line.

In an exemplary embodiment, the driving the organic light emitting diode may include applying a first level voltage of the first power source signal to the first electrode of the first transistor.

In an exemplary embodiment, each of the resetting the anode electrode and applying the data voltage may include applying the first level voltage of the first power source signal to the first electrode of the first transistor.

In an exemplary embodiment, each of the resetting the anode electrode and applying the data voltage may include applying a middle voltage between the first and second level voltages of the first power source signal to the first electrode of the first transistor.

In an exemplary embodiment, the reset voltage may correspond to a sum voltage of the second level voltage of the first power source signal and an average threshold voltage of a plurality of first transistors in a plurality of pixel circuits.

In an exemplary embodiment, the method may further include resetting the anode electrode of the organic light emitting diode using the reset voltage applied to the first voltage line between the applying the data voltage and the driving the organic light emitting diode.

According to the present disclosure, in the pixel circuit including three transistors and two capacitors that drive the organic light emitting diode, a voltage applied to the anode electrode of the organic light emitting diode is reset to the reset voltage to decrease or eliminate display defects.

BRIEF DESCRIPTION OF THE DRAWINGS

The above and other features and advantages of the present disclosure will become more apparent by describing in detailed exemplary embodiments thereof with reference to the accompanying drawings, in which.

DETAILED DESCRIPTION OF THE INVENTION

Hereinafter, the inventive concept will be explained in detail with reference to the accompanying drawings.

Figure 1:
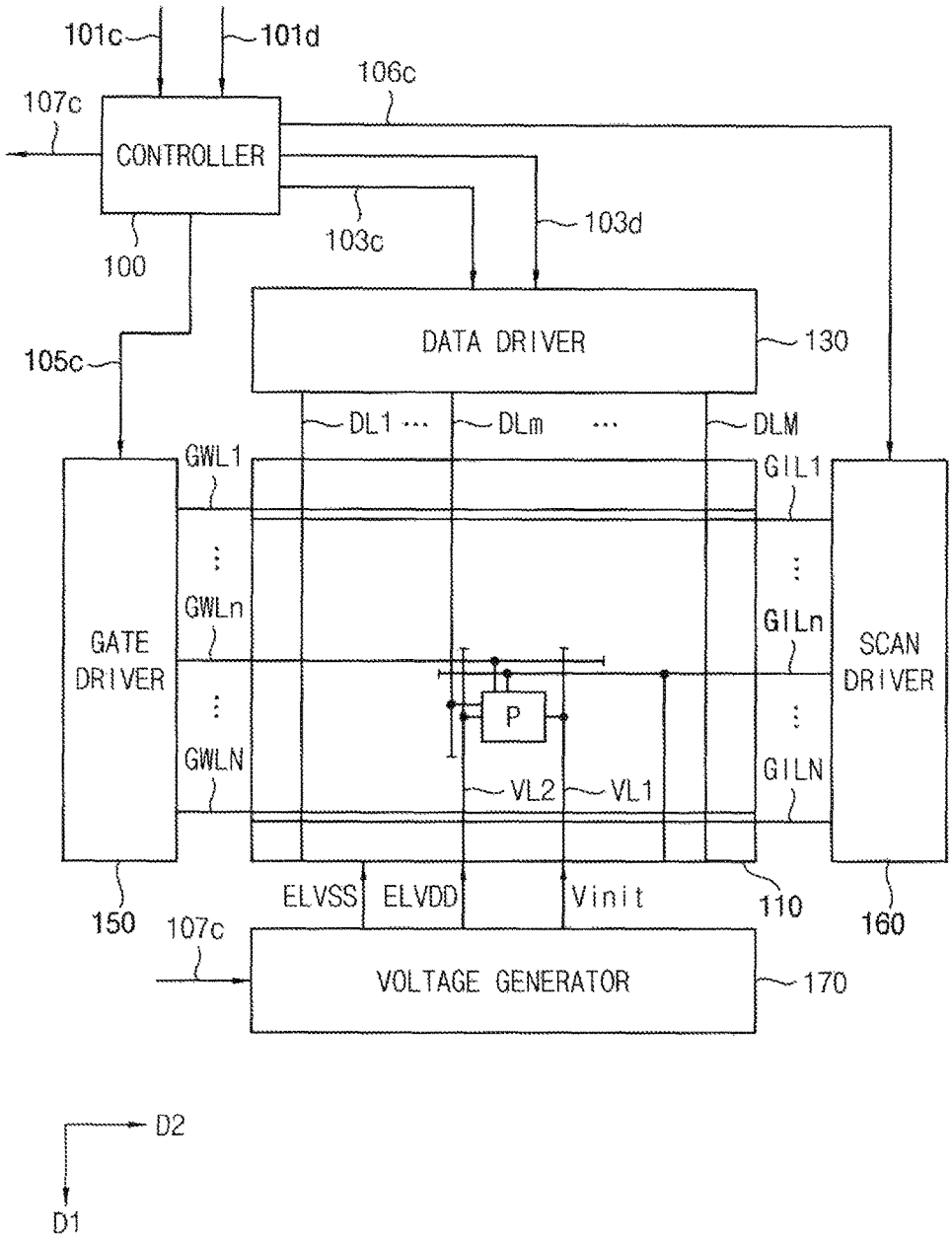
FIG. 1 is a block diagram illustrating a display apparatus according to an exemplary embodiment.

FIG. 1 is a block diagram illustrating a display apparatus according to an exemplary embodiment.

Referring to FIG. 1, the display apparatus may include a controller 100, a display part 110, a data driver 130, a gate driver 150, a scan driver 160, and a voltage generator 170.

The controller 100 may be configured to generally control the display apparatus to display an image on the display part 110. The controller 100 is configured to receive a control signal 101*c* and image data 101*d*. The controller 100 is configured to provide the data driver 130 with a first control signal 103*c* and the image data 103*d* to drive the data driver 130. The controller 100 is configured to provide the gate driver 150 with a second control signal 105*c* to drive the gate driver 150. The controller 100 is configured to provide the scan driver 160 with a third control signal 106*c* to drive the scan driver 160. The controller 100 is configured to provide the voltage generator 170 with a fourth control signal 107*c* to drive the voltage generator 170.

The controller 100 is configured to drive the display part 110 during a frame period which may include an initializing period, a compensating period, a data-programming period, and a light-emitting period. According to the exemplary embodiment, the data-programming period may include a reset period in which an anode electrode of an organic light emitting diode may be reset.

The display part 110 may include a plurality of pixels P, a plurality of data lines DL1, . . . , DLm, . . . , DLM, a plurality of gate lines GWL1, . . . , GWLn, . . . , GWLN, a plurality of first voltage lines VL1, a plurality of second voltage lines VL2 and a plurality of scan lines GIL1, . . . , GILn, . . . , GILN (wherein, n, N, m and M are natural number).

Each of the plurality of pixels P may include an organic light emitting diode and a pixel circuit PC that includes a plurality of transistors (e.g., three transistors) and a plurality of capacitors (e.g., two capacitors) to drive the organic light emitting diode.

The data lines DL1, . . . , DLm, . . . , DLM may respectively extend in a first direction D1 and be arranged in a second direction D2 crossing the first direction D1. Each data line DLm is configured to transfer a data voltage to pixels P that are arranged in the same pixel-column in the first direction D1.

The gate lines GWL1, . . . , GWLn, . . . , GWLN may extend in the second direction D2 and be arranged in the first direction D1. Each gate line GWLn is configured to transfer a gate signal to pixels P that are arranged in the same pixel-row in the second direction D2. During the data-programming period, the gate lines GWL1, . . . , GWLn, . . . , GWLN may sequentially transfer a plurality of gate signals to the plurality of pixel-rows.

The first voltage lines VL1 may transfer a driving signal Vinit to the plurality of pixels P, and the first voltage lines VL1 may be connected each other.

The second voltage lines VL2 may transfer a first power source signal ELVDD to a plurality of pixels P, and the second voltage lines VL2 may be connected to each other.

The scan lines GIL1, . . . , GILn, . . . , GILN may extend in the second direction D2 and be arranged in the first direction D1. Each of the scan lines GILn is configured to transfer a scan signal to pixels P that are arranged in the same pixel row in the second direction D2. During the data-programming period, the scan lines GIL1, . . . , GILn, . . . , GILN may sequentially transfer a plurality of scan signals to the plurality of pixel-rows.

The data driver 130 is configured to provide the data lines DL1, . . . , DLm, . . . , DLM with data voltages corresponding to the image data during the data-programming period of the frame period.

In addition, the data driver 130 is configured to provide the data lines DL1, . . . , DLm, . . . , DLM with a reference voltage. The reference voltage may be equal to or lower than a black voltage that corresponds to a black grayscale.

The gate driver 150 is configured to provide the gate lines GWL1, . . . , GWLn, . . . , GWLN with gate signals. The gate signal may have a first level voltage and a second level voltage. Hereinafter, "the first level voltage" may be referred to as "a high voltage" and "the second level voltage" may be referred to as "a low voltage." The gate driver 150 is configured to sequentially provide the gate lines GWL1, . . . , GWLn, . . . , GWLN with high voltages of the gate signals.

The scan driver 160 is configured to sequentially provide the scan lines GIL1, . . . , GILn, . . . , GILN with scan signals. The scan signal may have a high voltage and a low voltage. The scan signal may have a first level voltage and a second level voltage. Hereinafter, "the first level voltage" may be referred to as "a high voltage" and "the second level voltage" may be referred to as "a low voltage." The high voltage of the scan signal may be same as or different from the high voltage of the gate signal. The low voltage of the scan signal may be same as or different from the low voltage of the gate signal. The high and low voltages of the scan signal may be variously predetermined. The scan driver 160 is configured to sequentially provide the scan lines GIL1, . . . , GILn, . . . , GILN with high voltages of the scan signals. The high and low voltages of the scan signal may be the same or different from the high and low voltages of the gate signal.

The voltage generator 170 is configured to generate the driving signal Vinit, the first power source signal ELVDD, and a second power source signal ELVSS.

The driving signal Vinit may be applied to the first voltage line VL1, and may have a high voltage, a low voltage, and a reset voltage. Each of the high and low voltages of the driving signal Vinit may have a predetermined level to drive the pixel P. The reset voltage may have a predetermined level to reset the anode electrode of the organic light emitting diode. For example, the reset voltage may correspond to a sum voltage of a low voltage of the first power source signal ELVDD and an average threshold voltage of a plurality of first transistors in the pixel P.

The first power source signal ELVDD may be applied to the second voltage line VL2 and may have a high voltage and a low voltage. The high voltage of the first power source signal ELVDD may have a voltage of a normal positive power source signal, and the low voltage of the first power source signal ELVDD may have a predetermined low voltage to drive the pixel circuit PC.

The second power source signal ELVSS is applied to a common electrode of the pixels P. The common electrode of the pixels P may be a cathode electrode of an organic light emitting diode and have a voltage of a normal negative power source signal.

Figure 2:
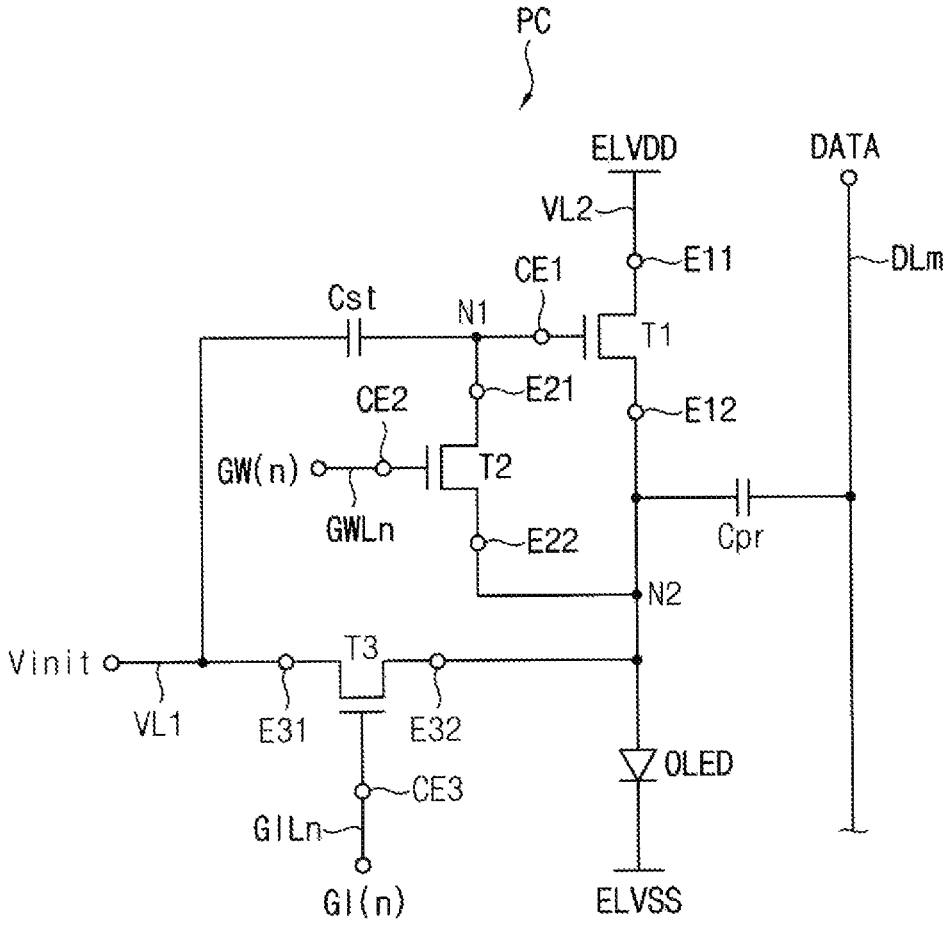
FIG. 2 is a circuit diagram illustrating a pixel circuit according to an exemplary embodiment.

FIG. 2 is a circuit diagram illustrating a pixel circuit according to an exemplary embodiment.

Referring to FIGS. 1 and 2, the pixel circuit PC may be included in a pixel P of a display part 110.

The pixel circuit PC may include an organic light emitting diode OLED, three transistors including a first transistor T1, a second transistor T2, and a third transistor T3, and two capacitors including a first capacitor Cst and a second capacitor Cpr.

According to the exemplary embodiment, the first, second and third transistors T1, T2 and T3 may be an N-type transistor. The N-type transistor may be turned on when a high voltage is applied to a control electrode, and turned off when a low voltage is applied to the control electrode. In some embodiments, the first, second and third transistors T1, T2 and T3 may be a P-type transistor. It is noted that other types of transistors may be used without deviating from the scope of the present disclosure.

The first transistor T1 may include a control electrode CE1 connected to a first node N1, a first electrode E11 connected to a second voltage line VL2, and a second electrode E12 connected to a second node N2. The second voltage line VL2 is configured to receive the first power source signal ELVDD.

The first power source signal ELVDD may have a high voltage that is a voltage of a normal positive power source signal and a low voltage that is a predetermined low voltage to drive the pixel circuit PC.

The second transistor T2 may include a control electrode CE2 connected to the n-th gate line GWLn, a first electrode E21 connected to the first node N1, and a second electrode E22 connected to the second node N2. The n-th gate line GWLn is configured to receive an n-th scan signal GW(n). The n-th scan signal GW(n) may have a high voltage that turns on the second transistor T2 and a low voltage that turns off the second transistor T2.

The third transistor T3 may include a control electrode CE3 connected to the n-th scan line GILn, a first electrode E31 connected to the first voltage line VL1, and a second electrode E32 connected to the second node N2. The first voltage line VL1 is configured to receive a driving signal Vinit.

The driving signal Vinit may have a high voltage, a low voltage, and a reset voltage to drive the pixel circuit PC. For example, the driving signal Vinit may have the low voltage to initialize the anode electrode of the organic light emitting diode OLED, the reset voltage to reset the anode electrode, and the high voltage to turn on the first transistor T1. The reset voltage may be lower than the low voltage of the driving signal Vinit or higher than the low voltage of the driving signal Vinit.

The n-th scan line GILn is configured to receive the n-th scan signal GI(n), and the n-th scan signal GI(n) may have a high voltage that turns on the third transistor T3 and a low voltage that turns off the third transistor T3.

The first capacitor Cst may be connected between the first voltage line VL1 and the first node N1. The first capacitor Cst may store a node voltage applied to the first node N1.

The second capacitor Cpr may be connected between the second node N2 and an m-th data line DLm. The second capacitor Cpr may store the data voltage applied to the m-th data line DLm.

The first and second capacitors Cst and Cpr may be serially connected between the m-th data line DLm and the first voltage line VL1 through the second transistor T2. The data voltage applied to the m-th data line DLm may be divided by a voltage division ratio of the first and second capacitors Cst and Cpr, and a divided data voltage may be applied to the first node N1.

The organic light emitting diode OLED may include an anode electrode connected to the second node N2 and a cathode electrode that receives the second power source signal ELVSS.

When the transistor T1 is turned on, a driving current corresponding to the data voltage applied to the first node N1 may flow through the organic light emitting diode OLED and thus, the organic light emitting diode OLED may emit the light.

Figure 3:
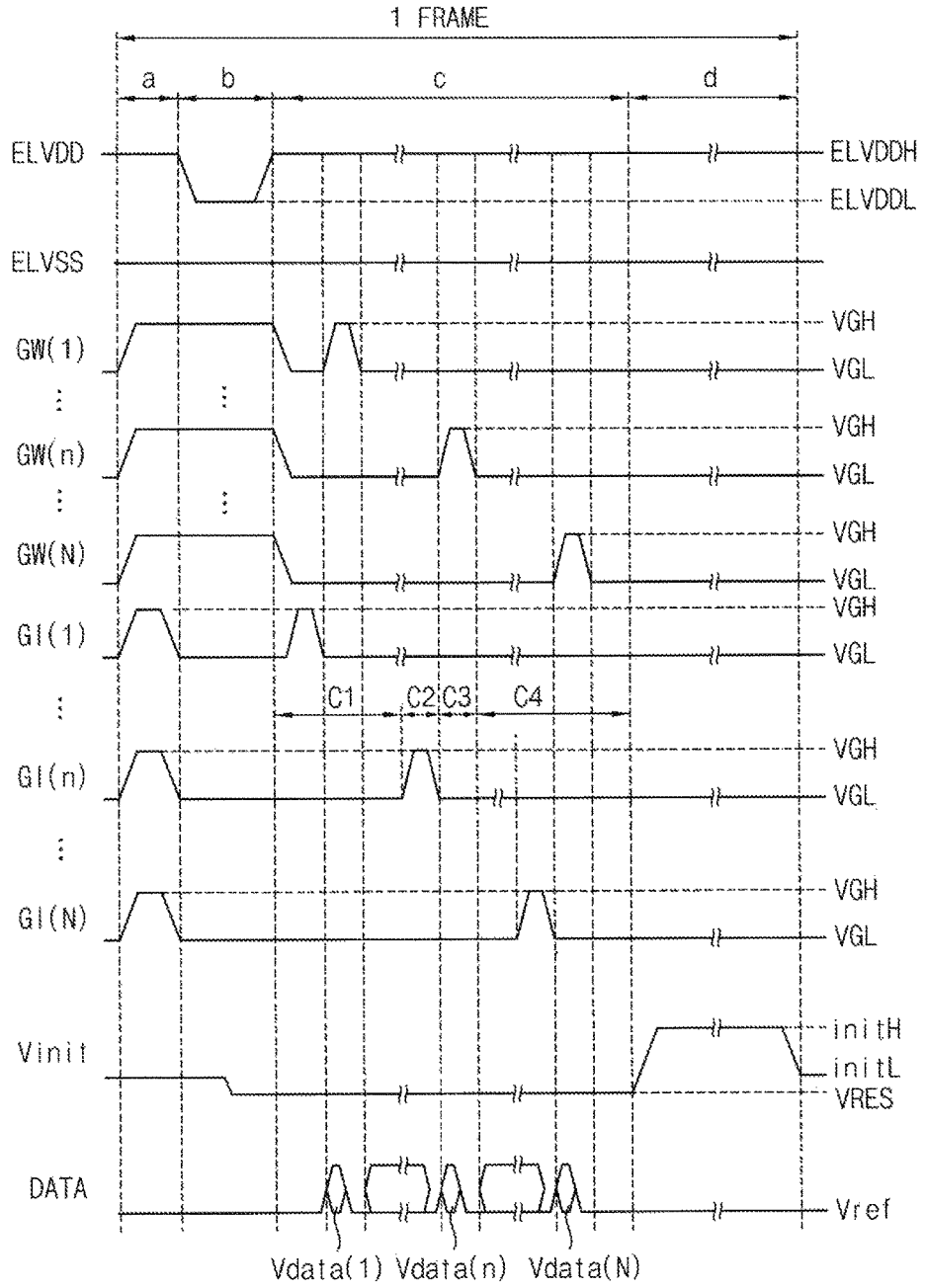
FIG. 3 is a timing chart illustrating a plurality of input signals of a display apparatus according to an exemplary embodiment.

FIG. 3 is a timing chart illustrating a plurality of input signals of a display apparatus according to an exemplary embodiment.

Referring to FIGS. 1, 2 and 3, the display part may receive a plurality of input signals. The plurality of input signals may include a driving signal Vinit applied to a first voltage line VL1, the first power source signal ELVDD applied to the second voltage line VL2, a plurality of gate signals GW(1), . . . , GW(n), . . . , GW(N) applied to plurality of gate lines GWL1, . . . , GWLn, . . . , GWLN, a plurality of scan signals GI(1), . . . , GI(n), . . . , GI(N) applied to the plurality of scan lines GIL1, . . . , GILn, . . . , GILN, a data voltage DATA applied to the plurality of data lines, and the second power source signal ELVSS applied to the cathode electrode of the organic light emitting diode OLED. The data voltage DATA may be referred to as a data voltage applied to the m-th data line DLm of the plurality of data lines.

The frame period may include a first period 'a' during which the anode electrode of the organic light emitting diode OLED is initialized, a second period 'b' during which the threshold voltage of the first transistor T1 is compensated, a third period 'c' during which the data voltage is applied to the pixel, and a fourth period 'd' during which the organic light emitting diode OLED emits the light.

Referring to the first period 'a', the first voltage line VL1 receives a low voltage initL of the driving signal Vinit. The low voltage initL of the driving signal Vinit may be defined as the following Equation 1:

$$ELVDD_L+V_{th,T1}<Init_L<ELVSS+V_{on,OLED} \quad \text{(Equation 1)}$$

In Equation 1, represents a threshold voltage of the first transistor T1, and $V_{on,OLED}$ represents a turn-on voltage of the organic light emitting diode OLED to emit the light.

The plurality of scan lines GIL1, . . . , GILn, . . . , GILN may simultaneously receive the high voltages VGH of the plurality of scan signals GI(1), . . . , GI(n), . . . , GI(N). For example, the n-th scan line GILn may receive the high voltage VGH of the n-th scan signal GI(n). The high voltage VGH of the n-th scan signal GI(n) may have a turn-on voltage of the third transistor T3. For example, the high voltage VGH of the scan signal may be about 10 V.

The second voltage line VL2 may receive a high voltage ELVDDH of the first power source signal ELVDD. The high voltage ELVDDH of the first power source signal ELVDD may have a voltage of a normal positive power source signal.

For example, the low voltage initL of the driving signal Vinit may be about −2.2 V, the high voltage ELVDDH of the first power source signal ELVDD may be about 7 V, the low voltage ELVDDL of the first power source signal ELVDD may be about −7 V, and the second power source signal ELVSS may be about 0 V.

The plurality of gate lines GWL1, . . . , GWLn, . . . , GWLN may simultaneously receive the high voltages VGH of the plurality of gate signals GW(1), . . . , GW(n), . . . , GW(N). The high voltage VGH of the gate signal may have a turn-on voltage of the second transistor T2. For example, the high voltage VGH of the scan signal may be about 10 V.

The plurality of data lines DL1, . . . , DLm, . . . , DLM may receive a reference voltage Vref. The reference voltage Vref may be equal to or lower than a lowest voltage in a voltage range of the data voltage. For example, when the voltage range of the data voltage is about 0.5V to about 7.5 V, the reference voltage Vref may be equal to or lower than about 0.5 V.

During the first period 'a', the anode electrodes of the organic light emitting diodes OLED that is connected to the second node N2 and the first node N1 in all pixels may be initialized by the low voltage initL of the driving signal Vinit, simultaneously.

Referring to the second period 'b', the first voltage line VL1 is configured to receive a voltage that transitions from the low voltage initL of the driving signal Vinit to the reset voltage VRES.

The plurality of scan lines GIL1, . . . , GILn, . . . , GILN is configured to simultaneously receive low voltages VGL of the plurality of scan signals GI(1), . . . , GI(n), . . . , GI(N). For example, the n-th scan line GILn may receive the low voltage VGL of the n-th scan signal GI(n). The low voltage VGL of the n-th scan signal GI(n) may have a turn-off voltage of the third transistor T3. For example, the low voltage VGL of the n-th scan signal GI(n) may be about −10 V.

The second voltage line VL2 is configured to receive a low voltage ELVDDL of the first power source signal ELVDD. For example, the low voltage ELVDDL of the first power source signal ELVDD may be about −7 V.

The plurality of gate lines GWL1, . . . , GWLn, . . . , GWLN is configured to simultaneously receive the high voltages VGH of the plurality of gate signals GW(1), . . . , GW(n), . . . , GW(N) as during the first period 'a'.

The plurality of data lines DL1, . . . , DLm, . . . , DLM is configured to receive the reference voltage Vref as during the first period 'a'.

During the second period 'b', the threshold voltages of the first transistors T1 in all pixels may be simultaneously compensated using the sum voltage of the low voltage ELVDDL of the first power source signal ELVDD and the threshold voltage of the corresponding first transistor T1.

Referring to the third period 'c', the first voltage line VL1 is configured to receive the reset voltage VRES. The second voltage line VL2 is configured to receive the high voltage ELVDDH of the first power source signal ELVDD. The plurality of gate lines GWL1, . . . , GWLn, . . . , GWLN is configured to sequentially receive the high voltages VGH of the plurality of gate signals GW(1), . . . , GW(n), . . . , GW(N). The plurality of scan lines GIL1, . . . , GILn, . . . , GILN is configured to sequentially receive the high voltages VGH of the plurality of scan signals GI(1), . . . , GI(n), . . . , GI(N).

The plurality of data lines DL1, . . . , DLm, . . . , DLM is configured to receive the data voltage DATA respectively corresponding to the plurality of horizontal lines in synchronization with the high voltages VGH of the plurality of gate signals GW(1), . . . ,GW(n), . . . , GW(N).

The third period c may include a first holding period c1, a reset period c2, a writing period c3, and a second holding period c4.

For example, referring to the pixel circuit PC in the n-th horizontal line as shown in FIG. 2, the first holding period c1 is a period during which the compensation voltage ELVDDL+ applied to the first node N1 may be maintained. During the first holding period c1, the n-th scan line GILn is configured to the low voltage VGL of the n-th scan signal GI(n). During the first holding period c1, the first, second, and third transistors T1, T2 and T3 may generate leakage currents according to the voltage regulation of the data voltage applied to the m-th data line DLm, and a voltage ELVDDL+$V_{th,T1}$+ΔV that is changed from ELVDDL+$V_{th,T1}$ by ΔV due to the voltage regulation of the data voltage may be applied to the anode electrode of the organic light emitting diode OLED.

During the reset period c2, the n-th scan line GILn is configured to receive the high voltage VGH of the n-th scan signal GI(n). The reset period c2 may include at least one horizontal of other gate lines period prior to the writing period c3 of the n-th gate line. The second transistor T2 is turned on in response to the high voltage VGH of the n-th scan signal GI(n), and the reset voltage VRES applied to the first voltage line VL1 is provided to the anode electrode of the organic light emitting diode OLED. Thus, during the first holding period c1, the voltage ELVDDL+$V_{th,T1}$+ΔV of the anode electrode that may cause the leakage currents of the first, second, and third transistors T1, T2 and T3 may be reset to the reset voltage VRES.

During the writing period c3, the n-th gate line GWLn is configured to receive the high voltage VGH of the n-th gate signal GW(n). The n-th scan line GILn is configured to receive the low voltage VGL of the n-th scan signal GI(n). The plurality of data lines DL1, . . . , DLm, . . . , DLM is configured to receive a data voltage Vdata(n) corresponding to the n-th horizontal line.

The second transistor T2 is turned on in response to the high voltage VGH of the n-th gate signal GW(n), and the first and second capacitors Cst and Cpr may be connected to each other in series. The data voltage applied to the m-th data line DLm may be divided by a voltage division ratio of the first and second capacitors Cst and Cpr, and the divided data voltage may be applied to the first node N1.

The second holding period c4 is a period during which the data voltage applied to the first node N1 may be maintained. During the second holding period c4, the n-th gate line GWLn is configured to receive the low voltage VGL of the n-th gate signal GW(n). The n-th scan line GILn is configured to receive the low voltage VGL of the n-th scan signal GI(n). The first and second transistors T1 and T2 are turned off in response to the low voltage VGL, and the divided data voltage applied to the first node N1 may be maintained by the first capacitor Cst.

Referring to the fourth period 'd', the second voltage line VL2 is configured to receive the high voltage ELVDDH of the first power source signal ELVDD.

The first voltage line VL1 is configured to receive a high voltage initH of the driving signal Vinit. The high voltage initH of the driving signal Vinit may be determined to be a high level for turning on the first transistor T1. For example, the high voltage initH of the driving signal Vinit may be about 6.5 V.

The plurality of scan lines GIL1, . . . , GILn, . . . , GILN is configured to simultaneously receive the low voltages VGL of the plurality of scan signals GI(1), . . . , GI(n), . . . ,GI(N).

The plurality of gate lines GWL1, . . . , GWLn, . . . , GWLN is configured to simultaneously receive the low voltages VGL of the plurality of gate signals GW(1), . . . ,GW(n), . . . , GW(N).

The plurality of data lines DL1, . . . , DLm, . . . , DLM is configured to simultaneously receive the reference voltage Vref.

During the fourth period 'd', a driving current corresponding to the data voltage applied to the first node N1 may be provided to the organic light emitting diode OLED, and the organic light emitting diode OLED may emit the light. Thus, the organic light emitting diodes OLED in all pixels may simultaneously emit the light.

As described above, according to the exemplary embodiment, the voltage applied to the anode electrode is reset to the reset voltage before the data voltage is written to the pixel circuit PC and thus, a display defect by the leakage currents of the transistors may be decreased or eliminated.

Figure 4A:
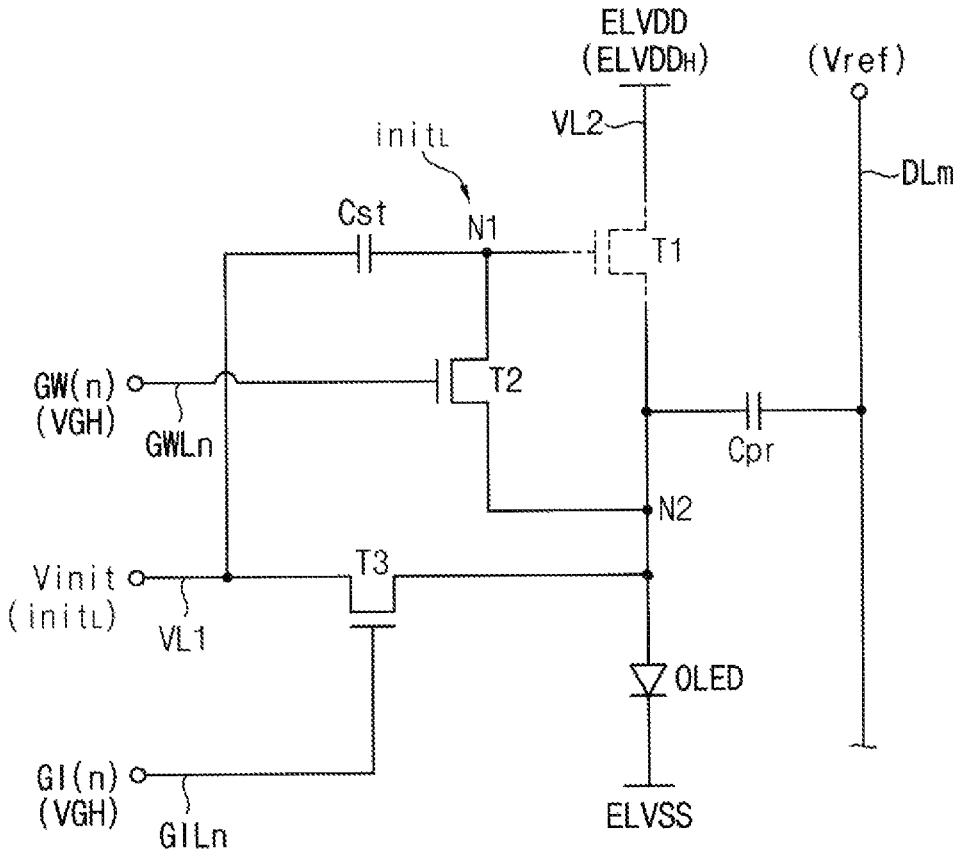
FIGS. 4A and 4B are conceptual diagrams illustrating a method of driving the pixel circuit according to an exemplary embodiment.
Figure 4B:
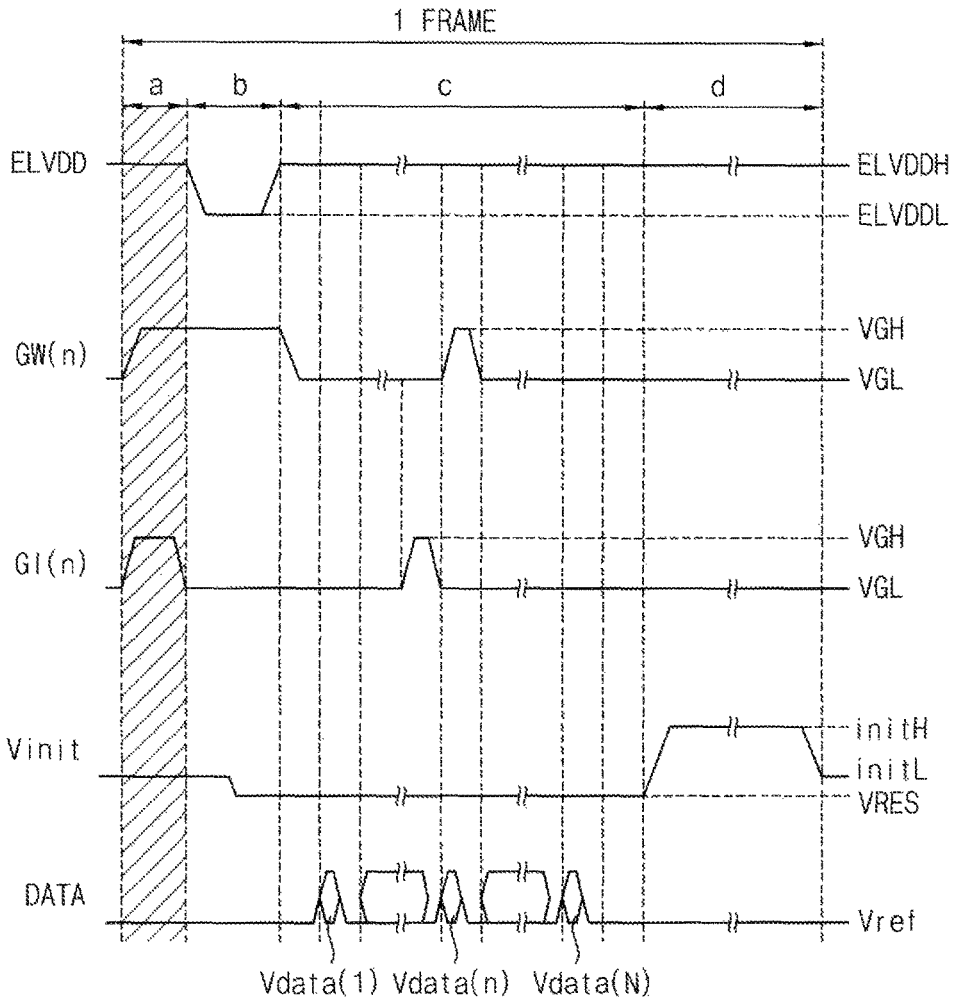

FIGS. 4A and 4B are conceptual diagrams illustrating a method of driving the pixel circuit according to an exemplary embodiment.

Referring to FIGS. 4A and 4B, the first period 'a' may correspond to an initializing period of the organic light emitting diode OLED.

In the first period 'a', the low voltage initL of driving signal Vinit is applied to the first voltage line VL1, the high voltage VGH of the n-th scan signal GI(n) is applied to the n-th scan line GILn, and the high voltage ELVDDH of the first power source signal ELVDD is applied to the second voltage line VL2. The n-th gate signal GW(n) receives the high voltage VGH of the n-th gate signal GW(n). The m-th data line DLm receives the reference voltage Vref.

Referring to a method of driving the pixel circuit PC, the low voltage initL of the driving signal Vinit is applied to the first node N1. The second transistor T2 is turned on in response to the high voltage VGH of the n-th gate signal GW(n).

The third transistor T3 is turned on in response to the high voltage VGH of the n-th scan signal GI(n), and the low voltage initL of the driving signal Vinit is provided to the second node N2. The anode electrode of the organic light emitting diode OLED connected to the second node N2 may be initialized by the low voltage initL of the driving signal Vinit.

Therefore, during the first period 'a', the organic light emitting diode OLED may be initialized.

Figure 5A:
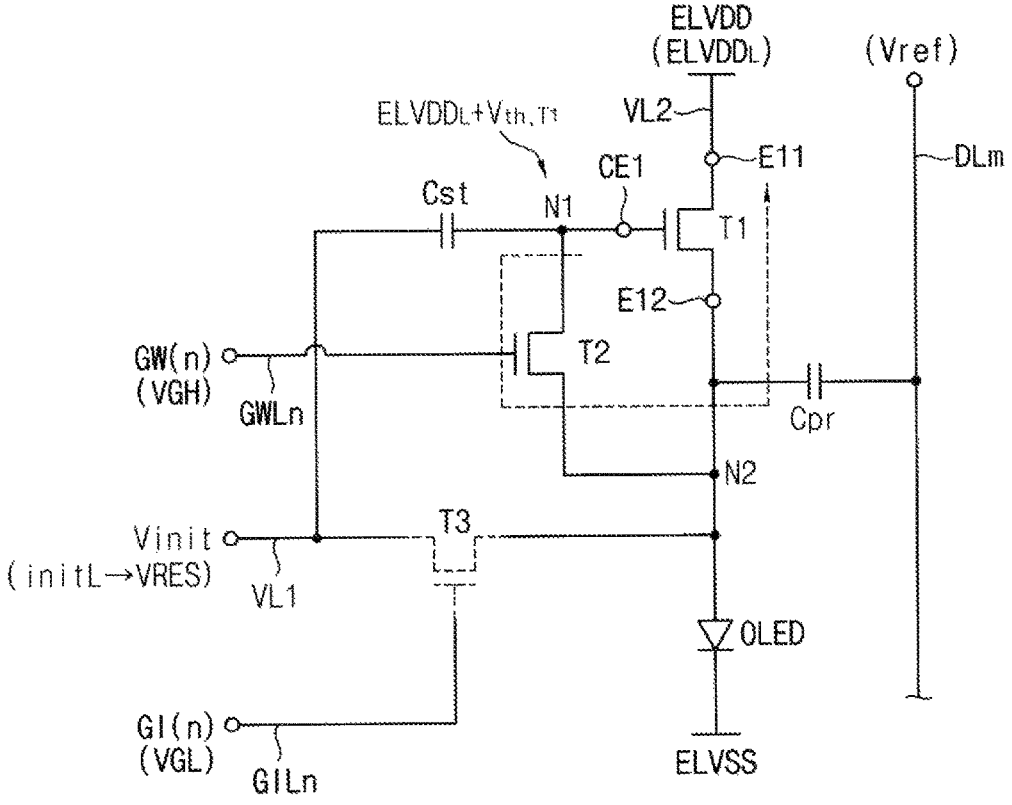
FIGS. 5A and 5B are conceptual diagrams illustrating a method of driving the pixel circuit according to an exemplary embodiment.
Figure 5B:
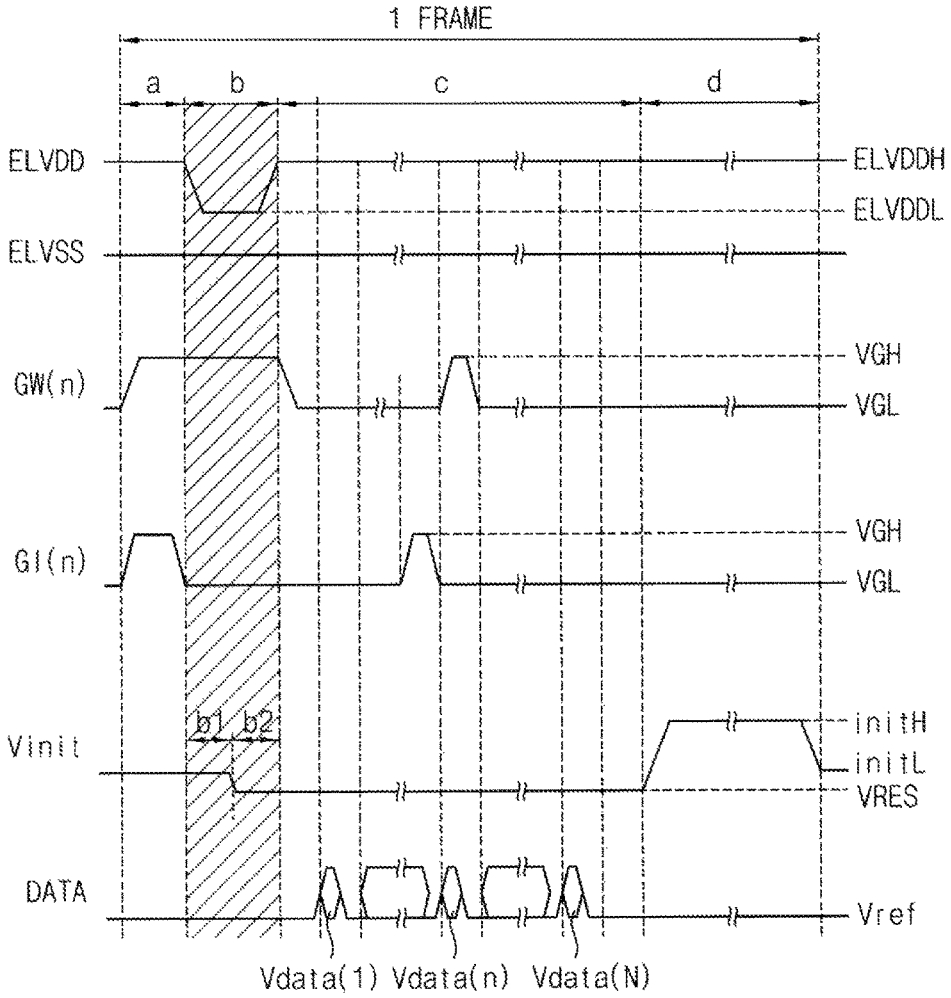

FIGS. 5A and 5B are conceptual diagrams illustrating a method of driving the pixel circuit according to an exemplary embodiment.

Referring to FIGS. 5A and 5B, the second period 'b' may correspond to a compensating period during which the threshold voltage of the first transistor T1 is compensated.

Referring to the second period 'b', the first voltage line VL1 is configured to receive the low voltage initL of the driving signal Vinit in an early part b1 of the second period 'b' and the reset voltage VRES Vinit in a latter part b2 of the second period 'b'. The n-th scan line GILn is configured to receive the low voltage VGL of the n-th scan signal GI(n), and the n-th gate line GWLn is configured to receive the high voltage VGH of the n-th gate signal GW(n). The second voltage line VL2 is configured to receive the low voltage ELVDDL of the first power source signal ELVDD. The m-th data line receives the reference voltage Vref.

Referring to a method of driving the pixel circuit PC, during the early part bl of the second period b, the low voltage initL of the driving signal Vinit is applied to the first node N1. The second transistor T2 is turned on in response to the high voltage VGH of the n-th gate signal GW(n), and the low voltage initL of the driving signal Vinit applied to the first node N1 is applied to the second node N2. The third transistor T3 is turned off in response to the low voltage VGL of the n-th scan signal GI(n).

The control electrode CE1 of the first transistor T1 is connected to the second electrode E12 of the first transistor T1 by the second transistor T2, and the low voltage ELVDDL of the first power source signal is applied to the first electrode E11 of the first transistor T1.

The voltage ELVDDL applied to the first electrode E11 of the first transistor T1 may be lower than the low voltage initL of the driving signal Vinit that is applied to the second electrode E12. In this case, the first electrode E11 may drive as a source and the second electrode E12 may drive as a drain.

Therefore, when the second transistor T2 is turned on, the gate and drain of the first transistor T1 are connected to each other, and the first transistor T1 is diode-connected.

When the first transistor T1 is diode-connected, the first node N1 connected to the control electrode CE1 of the first transistor T1 receives a voltage corresponding to a sum voltage of the low voltage ELVDDL of the first power source signal and the threshold voltage of the first transistor T1.

During the latter part b2 of the second period b, the first voltage line VL1 is configured to receive the reset voltage VRES. The reset voltage VRES may be determined to a reset level for resetting a voltage applied to the anode electrode of the organic light emitting diode OLED. For example, the reset voltage VRES may be the threshold compensation voltage ELVDDL+$V_{th,T1}$ that is applied to the first node N1. In another example, the reset voltage VRES may be a sum voltage of the low voltage ELVDDL of the first power source signal ELVDD and an average threshold voltage $V_{th_{AVG}T1}$ of the plurality of first transistors T1.

Figure 6A:
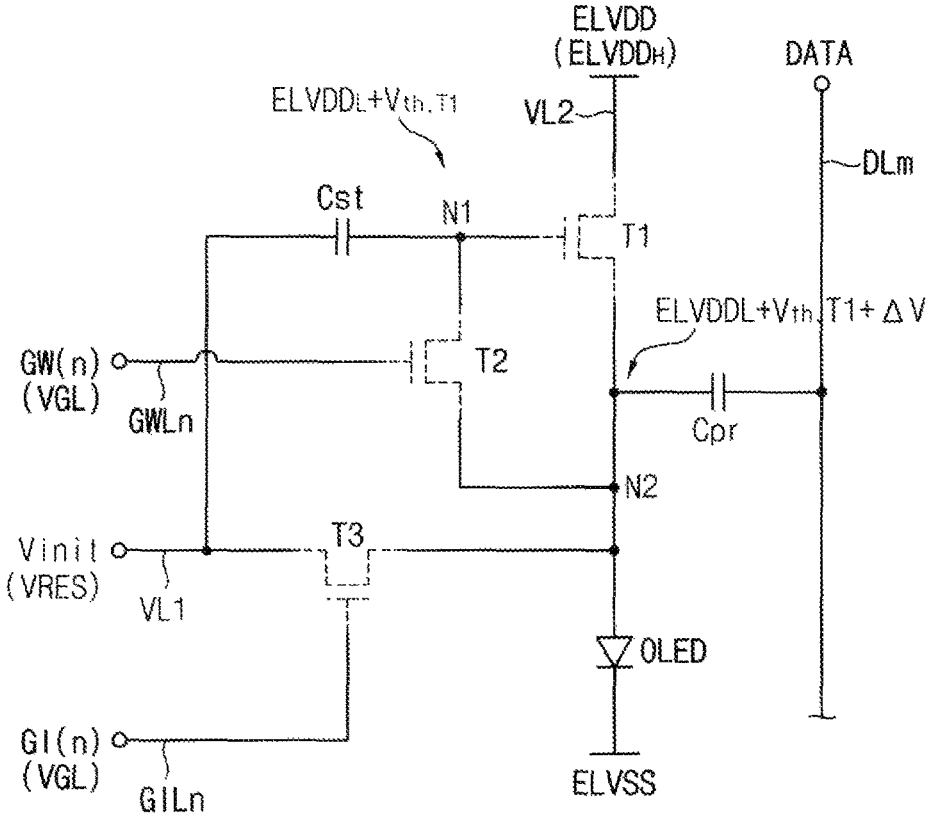
FIGS. 6A and 6B are conceptual diagrams illustrating a method of driving the pixel circuit according to an exemplary embodiment.
Figure 6B:
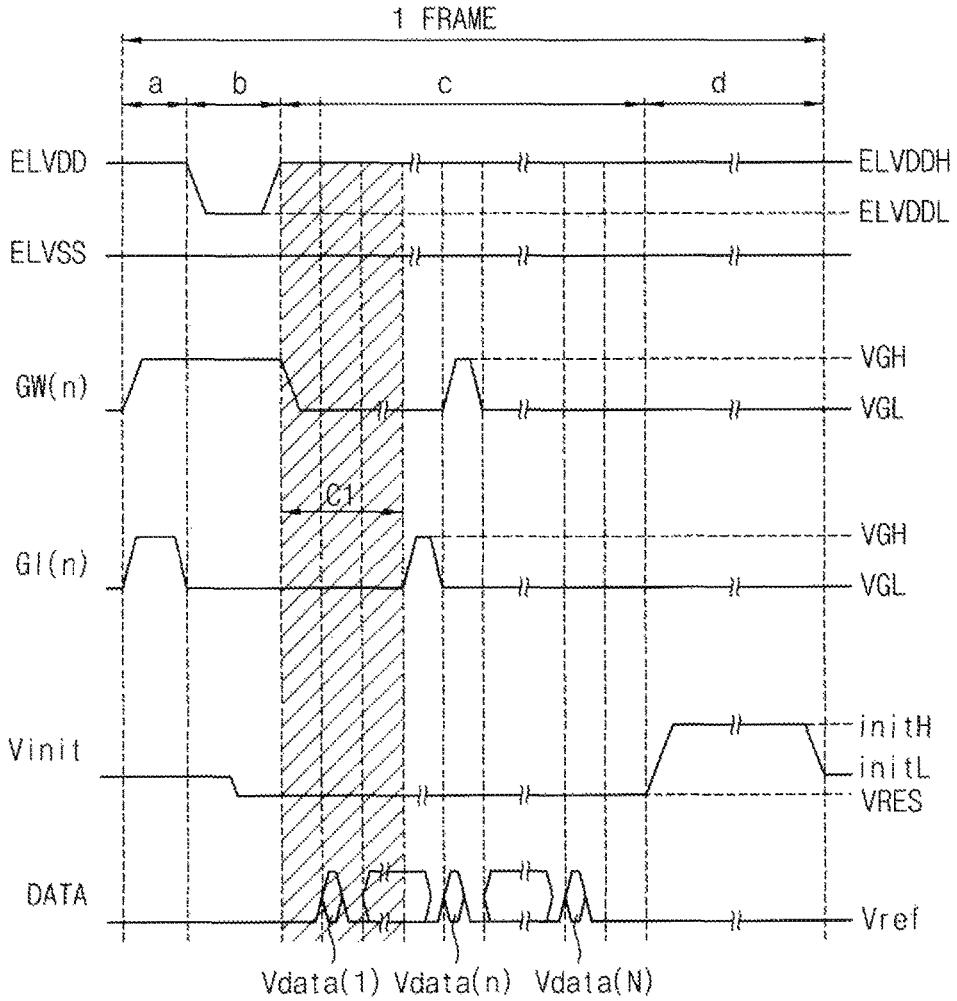

FIGS. 6A and 6B are conceptual diagrams illustrating a method of driving the pixel circuit according to an exemplary embodiment.

Referring to FIGS. 6A and 6B, the third period 'c' may correspond to a data-programming period during which the data voltage is applied to the plurality of pixels.

The third period c may include a first holding period c1, a reset period c2, a writing period c3, and a second holding period c4 as shown in FIG. 3. The first holding period c1 may increase along a scan direction of the display part. The reset period c2 may be placed between the first holding period c1 and the writing period c3. The second holding period c4 may be placed after the writing period c3.

Referring to the pixel circuit PC in the n-th horizontal line, during the first holding period c1, the first voltage line VL1 is configured to receive the reset voltage VRES, the n-th scan line GILn is configured to receive the low voltage VGL of the n-th scan signal GI(n), and the n-th gate line GWLn is configured to receive the low voltage VGL of the n-th gate signal GW(n). The first node N1 may have the threshold compensation voltage ELVDDL+$V_{th,T1}$. The first transistor T1 is turned off in response to a voltage of the first node N1, and the second and third transistors T2 and T3 is turned off in response to the low voltage VGL.

However, the m-th data line DLm may sequentially receive previous data voltages corresponding to previous horizontal lines. The anode electrode of the organic light emitting diode OLED may receive a changing voltage ELVDDL+$V_{th,T3}$+ΔV according to voltage regulations of the previous data voltages. The leakage current of the first transistor T1 may occur by the changing voltage applied to the anode electrode.

The first holding period c1 may increase toward a lower area of the display part in the scan direction so that the leakage current may increase toward the lower area of the display part. An image displayed on the display part may have gradation defects of luminance increasing toward the lower area of the display part by the leakage current. In addition, crosstalk defects may be viewed in the lower area of the display part when a black box is displayed on the display part.

Figure 7A:
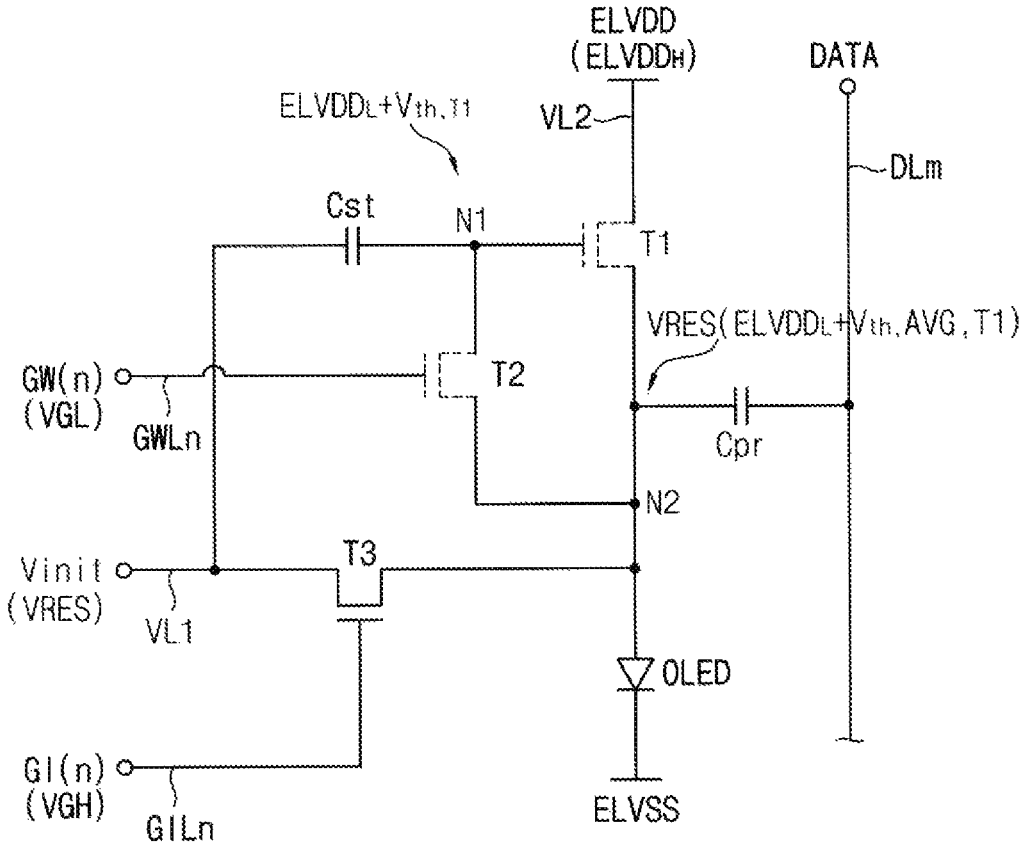
FIGS. 7A and 7B are conceptual diagrams illustrating a method of driving the pixel circuit according to an exemplary embodiment.
Figure 7B:
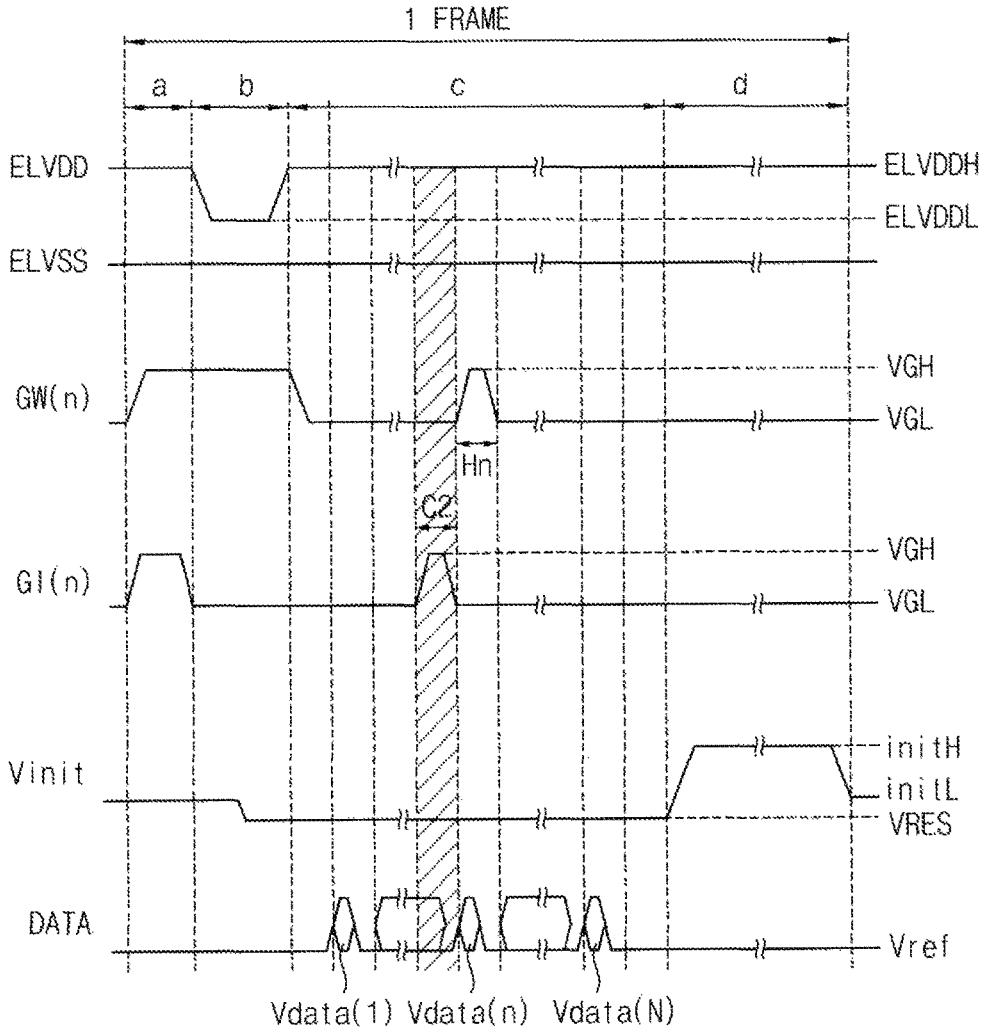

FIGS. 7A and 7B are conceptual diagrams illustrating a method of driving the pixel circuit according to an exemplary embodiment.

Referring to FIGS. 7A and 7B, during the reset period c2, the first voltage line VL1 is configured to the reset voltage VRES, the n-th gate line GWLn is configured to the low voltage VGL of the n-th gate signal GW(n), and the n-th scan line GILn is configured to the high voltage VGH of the n-th scan signal GI(n).

The reset period c2 may include at least one horizontal period of other gate lines prior to the n-th horizontal period Hn corresponding to the writing period c3 of the n-th gate line.

The first and second transistors T1 and T2 are turned off, and the third transistor T3 is turned on in response to the high voltage VGH of the n-th scan signal GI(n).

The reset voltage VRES applied to the first voltage line VL1 is applied to the second node N2 through the third transistor T3. The reset voltage VRES may be the sum v of the low voltage ELVDDL of the first power source signal ELVDD and an average threshold voltage $V_{th_{AVG}T2}$ of the plurality of first transistors.

Therefore, during the reset period c2, the changing voltage ELVDDL+$V_{th,T3}$−+ΔV applied to the anode electrode of the organic light emitting diode OLED may be reset to the reset voltage VRES.

According to the exemplary embodiment, the anode electrode is reset to the reset voltage VRES and thus, the gradation defects of luminance and the crosstalk defects by the changing voltage of the anode electrode may be decreased or eliminated.

Figure 8A:
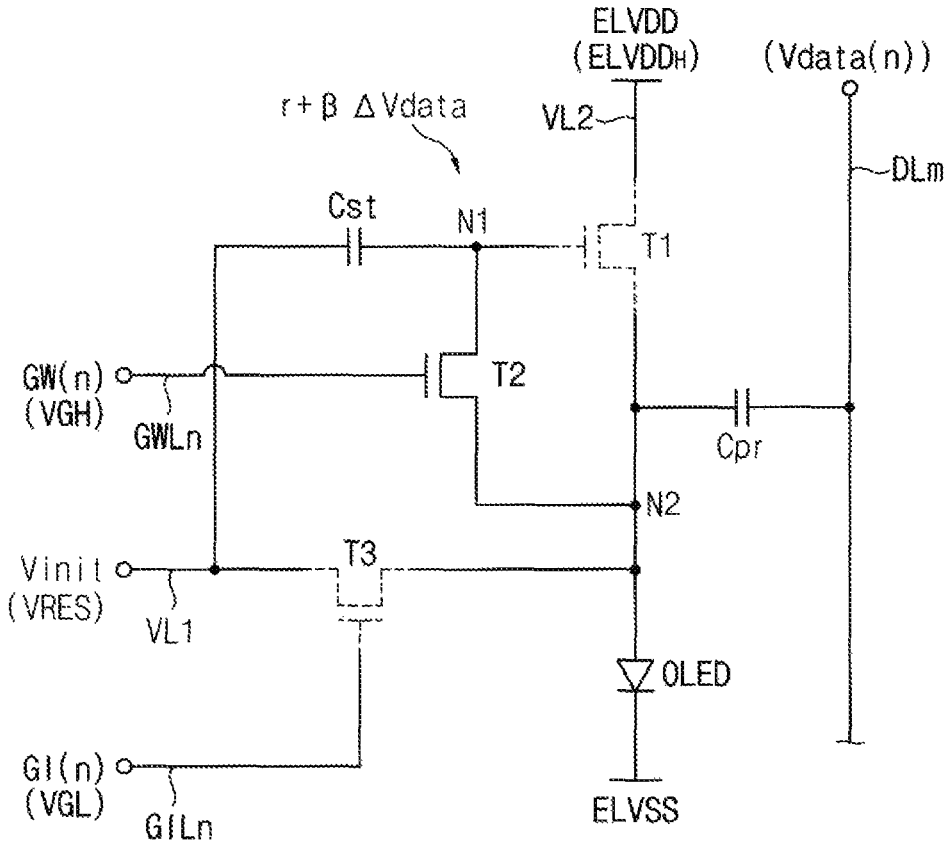
FIGS. 8A and 8B are conceptual diagrams illustrating a method of driving the pixel circuit according to an exemplary embodiment.
Figure 8B:
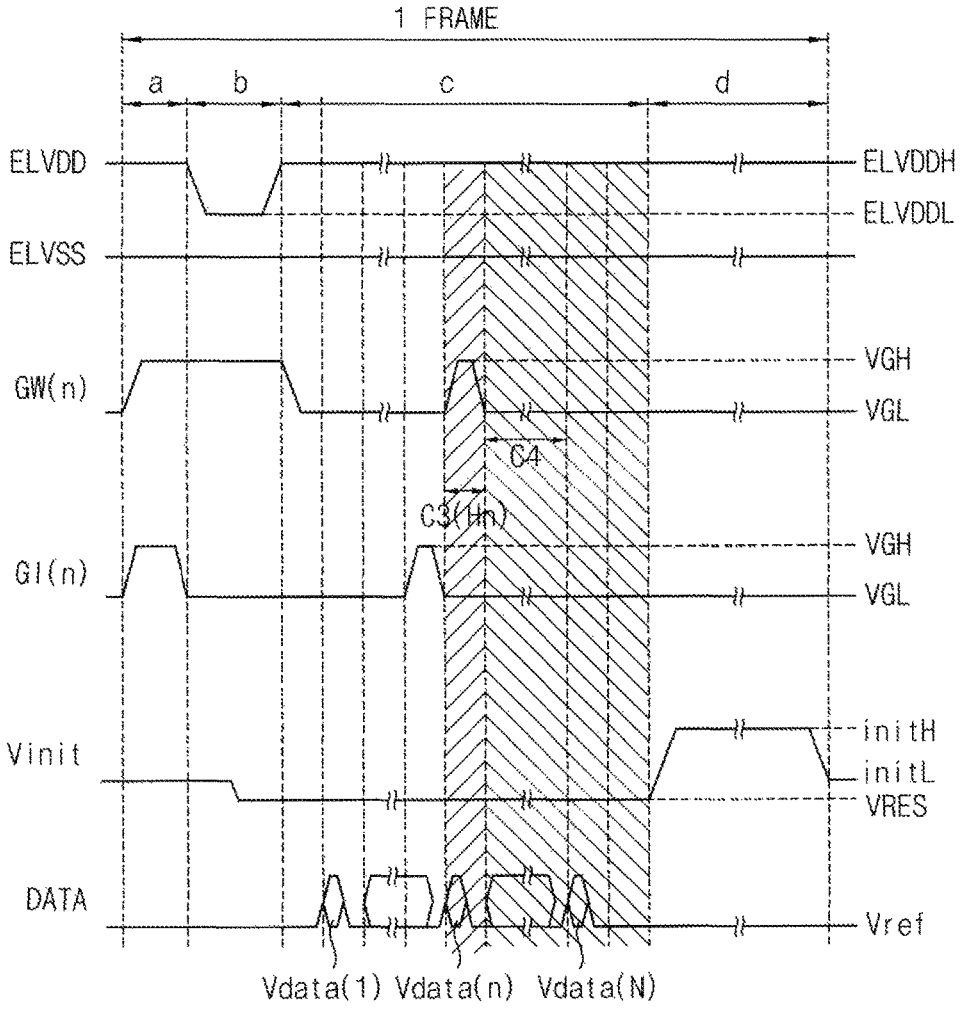

FIGS. 8A and 8B are conceptual diagrams illustrating a method of driving the pixel circuit according to an exemplary embodiment.

Referring to FIGS. 8A and 8B, during the writing period c3, the first voltage line VL1 is configured to the reset voltage VRES, the n-th gate line GWLn is configured to the high voltage VGH of the n-th gate signal GW(n), the n-th scan line GILn is configured to the low voltage VGL of the n-th scan signal GI(n). The plurality of data lines DL1, . . . , DLm, . . . , DLM is configured to a data voltage Vdata(n) of the n-th horizontal line.

The m-th data line DLm is configured to receive the data voltage Vdata(n) of the pixel circuit PC in the n-th horizontal line. For example, the m-th data line DLm may be configured to receive the data voltage Vdata(n) of the pixel circuit PC during an early part of an n-th horizontal period Hn corresponding to the n-th horizontal line and to receive the reference voltage Vref during a latter part of the n-th horizontal period Hn.

Referring to the method of driving the pixel circuit PC, the reset voltage VRES of the driving signal Vinit is applied to the first node N1. Because the control electrode CE1 of the first transistor T1 is connected to the first node N1, the first transistor T1 is turned off. The third transistor T3 is turned off in response to the low voltage VGL of the n-th scan signal GI(n).

The second transistor T2 is turned on in response to the high voltage VGH of the n-th gate signal GW(n), and the first node N1 and the second node N2 are connected to each other in series. The first capacitor Cst and the second capacitor Cpr are connected to each other in series through the second transistor T2 that is turned on.

The m-th data line DLm is configured to receive the n-th data voltage Vdata(n) corresponding to the pixel circuit PC. The m-th data line DLm may have a difference voltage ΔVdata between the n-th data voltage Vdata(n) and the reference voltage Vref.

The first and second capacitors Cst and Cpr that are connected to the first node N1 in series has a voltage division ratio á corresponding to the first node N1. The voltage division ratio â and the difference voltage ΔVdata may be defined as the following Equation 2.

$$\beta = Cpr/(Cst+Cpr)$$

$$\Delta V_{data} = V_{data(n)} - V_{ref} \quad \text{(Equation 2)}$$

Therefore, the difference voltage ΔVdata is divided by the voltage division ratio â of the first and second capacitors Cst and Cpr, and the divided voltage â·ΔVdata corresponding to the n-th data voltage Vdata(n) is applied to the first node N1.

Therefore, a voltage defined as the following Equation 3 may be applied to the first node N1 during the n-th horizontal period Hn.

$$\gamma + \beta IV_{data}, \quad \text{(Equation 3)}$$

where $\gamma = [(ELVDD = V_{th,T1})Cst + V_{RES}(Cpr+Cel)]/(Cst+Cpr+Cel)$.

In Equation 3, 'Cel' is a parasitic capacitance of the organic light emitting diode OLED.

During the second holding period c4, the first voltage line VL1 is configured to receive the reset voltage VRES, the n-th gate line GWLn is configured to receive the low voltage VGL of the n-th gate signal GW(n), and the n-th scan line GILn is configured to receive the low voltage VGL of the n-th scan signal GI(n). The first and second transistors T1 and T2 are turned off in response to the low voltage VGL. The data voltage applied to the first node N1 is stored in the first capacitor Cst and thus is maintained during the second holding period c4. The second holding period c4 may decrease toward the lower area of the display part in the scan direction.

Figure 9A:
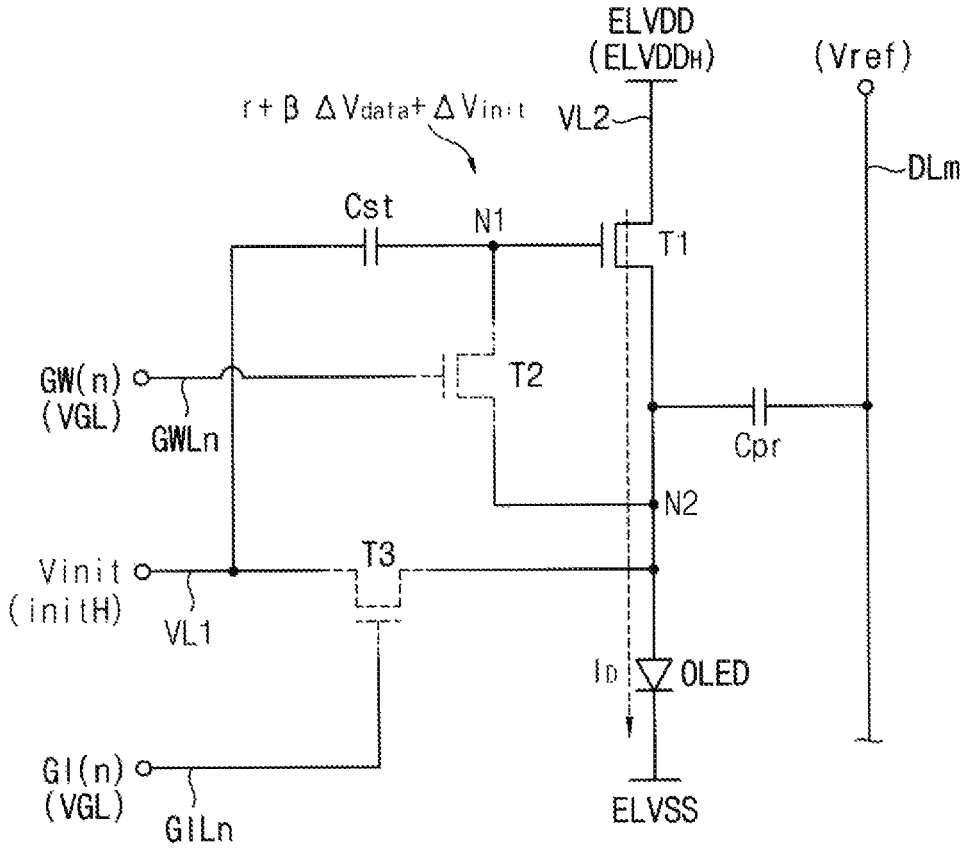
FIGS. 9A and 9B are conceptual diagrams illustrating a method of driving the pixel circuit according to an exemplary embodiment.
Figure 9B:
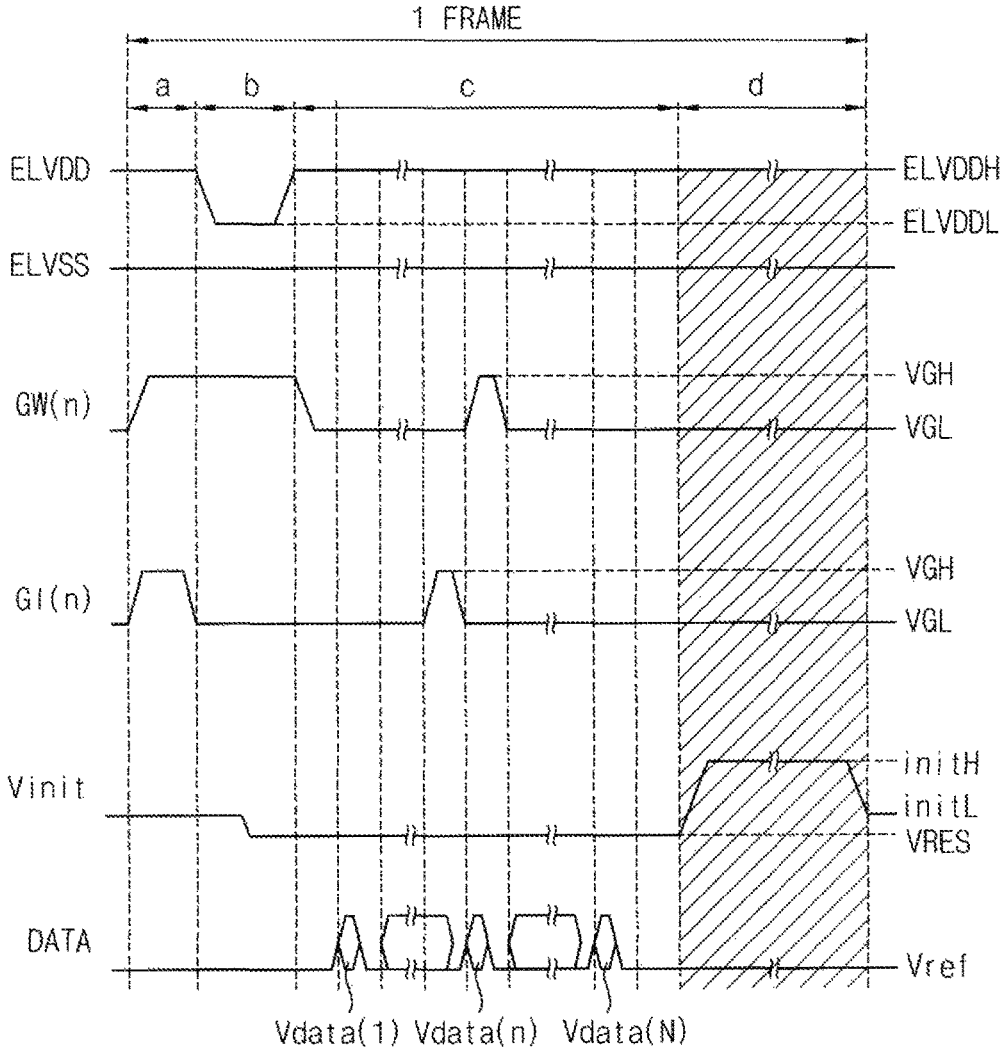

FIGS. 9A and 9B are conceptual diagrams illustrating a method of driving the pixel circuit according to an exemplary embodiment.

Referring to FIGS. 9A and 9B, fourth period d the fourth period 'd' may correspond to a light-emitting period during which the organic light emitting diode OLED emits the light.

Referring to the fourth period 'd', the high voltage initH of the driving signal Vinit is applied to the first voltage line VL1, the high voltage ELVDDH of the first power source signal ELVDD is applied to the second voltage line VL2, the low voltage VGL of the n-th scan signal GI(n) is applied to the n-th scan line GILn, and the low voltage of the n-th gate signal GW(n) VGL is applied to the n-th gate line GWLn. The m-th data line DLm receives the reference voltage Vref.

Referring to the method of driving the pixel circuit PC, the high voltage initH of the driving signal Vinit is applied to the first node N1 and thus, a voltage defined as the following Equation 4 may be applied to the first node N1.

$$\gamma + \beta IV_{data} + IV_{unit} \quad \text{(Equation 4)}$$

In Equation 4, a difference voltage ΔVinit represents a difference voltage between the high and low voltages initH and initL of the driving signal Vinit.

When the voltage defined as Equation 4 is applied to the control electrode CE1 of the first transistor T1, the first transistor T1 is turned on based on the difference voltage ΔVinit.

The second transistor T2 is turned off in response to the low voltage VGL of the n-th gate signal GW(n), and the third transistor T3 is turned off in response to the low voltage VGL of the n-th scan signal GI(n).

Therefore, the first transistor T1 is turned on and thus, a driving current ID corresponding to the data voltage may flow through the organic light emitting diode OLED, and the organic light emitting diode OLED may emit the light.

According to the exemplary embodiment, in the pixel circuit PC, the changing voltage applied to the anode electrode of the organic light emitting diode is reset to the reset voltage and thus, display defects may be decreased or eliminated.

Figure 10:
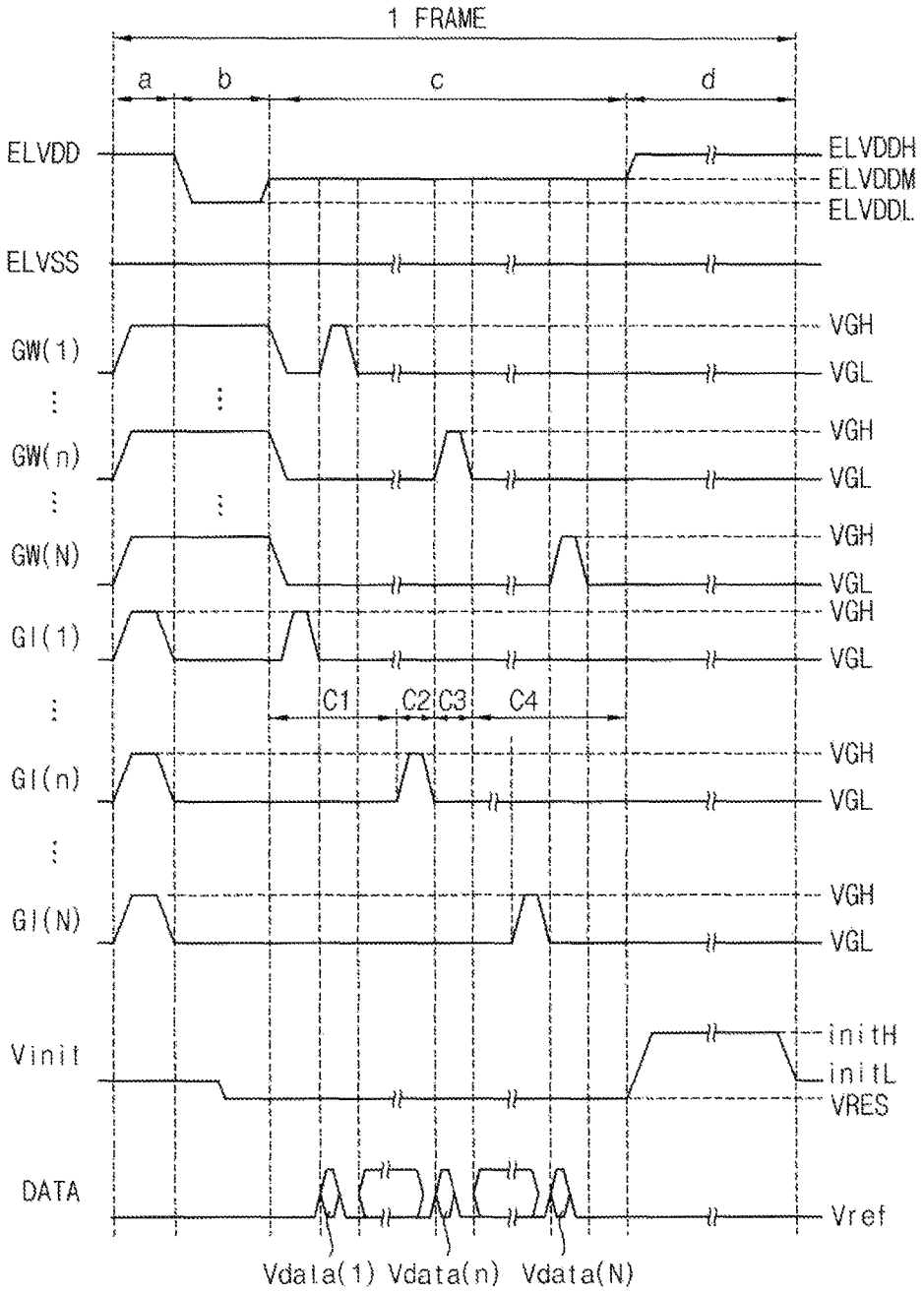
FIG. 10 is a timing chart illustrating a plurality of input signals of a display apparatus according to an exemplary embodiment.
Figure 11:
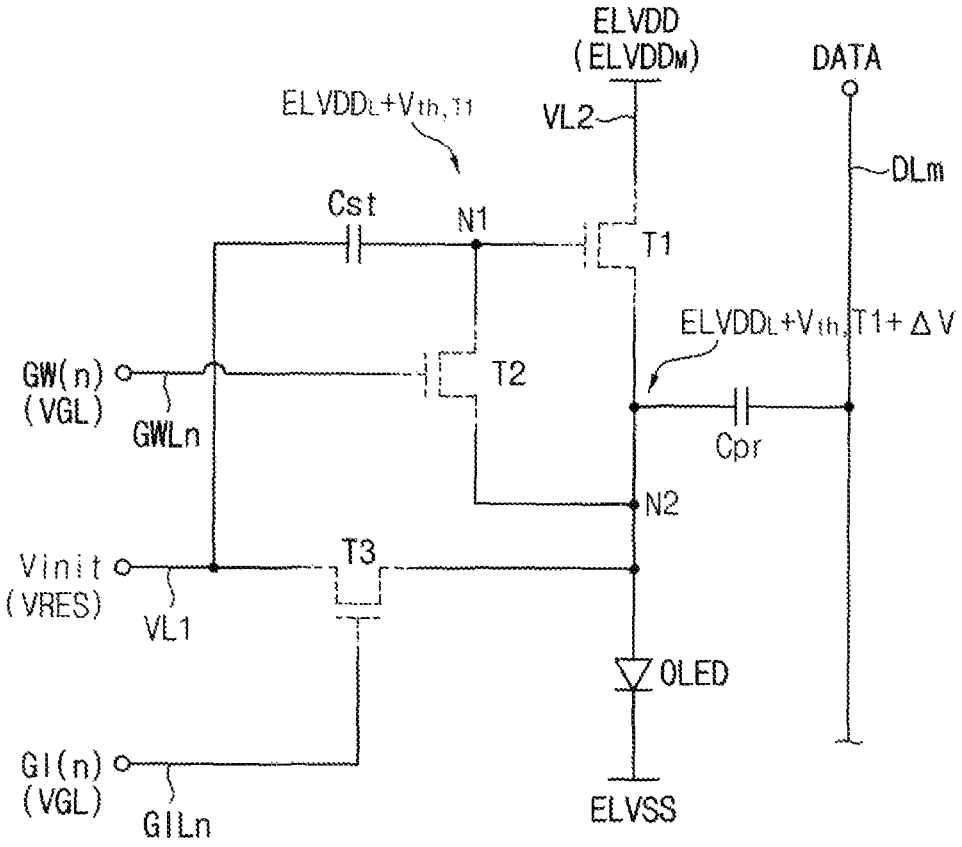
FIG. 11 is a conceptual diagram illustrating a method of driving the pixel circuit according to an exemplary embodiment.

FIG. 10 is a timing chart illustrating a plurality of input signals of a display apparatus according to an exemplary embodiment. FIG. 11 is a conceptual diagram illustrating a method of driving the pixel circuit according to an exemplary embodiment.

According to the exemplary embodiment, the method of driving the pixel circuit PC in comparison with the method of driving the pixel circuit PC according to the previous exemplary embodiment may include that the second voltage line VL2 is configured to receive a middle voltage ELVDDM of the first power source signal ELVDD during the third period 'c'. Hereinafter, the same reference numerals are used to refer to the same or like parts as those described in the previous exemplary embodiments, and the same detailed explanations may be simplified or omitted.

Referring to FIGS. 10 and 11, according to the exemplary embodiment, during the third period c, the first voltage line VL1 is configured to receive the reset voltage VRES, the second voltage line VL2 is configured to receive the middle voltage ELVDDM of the first power source signal ELVDD.

The middle voltage ELVDDM may have a voltage level between the high voltage ELVDDH of the first power source signal ELVDD and the low voltage ELVDDL of the first power source signal ELVDD. The middle voltage ELVDDM may be determined to satisfy a condition in which the first transistor T1 is turned off during the third period c.

The plurality of gate lines GWL1, . . . , GWLn, . . . , GWLN may sequentially receive the high voltages VGH of the plurality of gate signals GW(1), . . . , GW(n), . . . , GW(N). The plurality of scan lines GIL1, . . . , GILn, . . . , GILN may sequentially receive the high voltages VGH of the plurality of scan signals GI(1), . . . , GI(n), . . . , GI(N).

The plurality of data lines DL1, . . . , DLm, . . . , DLM is configured to receive the data voltage DATA respectively corresponding to the plurality of horizontal lines in synchronization with the high voltages VGH of the plurality of gate signals GW(1), . . . , GW(n), . . . , GW(N).

Referring to the pixel circuit PC in the n-th horizontal line as shown in FIG. 11, during the first holding period c1 of the third period c, the second voltage line VL2 is configured to receive the middle voltage ELVDDM of the first power source signal ELVDD, the first voltage line VL1 is configured to receive the reset voltage VRES, the n-th scan line GILn is configured to receive the low voltage VGL of the n-th scan signal GI(n), and the n-th gate line GWLn is configured to receive the low voltage VGL of the n-th gate signal GW(n). The first node N1 may maintain the threshold compensation voltage ELVDDL+$V_{th,T2}$, the first transistor T1 is turned off in response to the voltage of the first node N1, and the second and third transistors T2 and T3 are turned off in response to the low voltage VGL.

However, the m-th data line DLm may sequentially receive previous data voltages corresponding to previous horizontal lines. The anode electrode of the organic light emitting diode OLED may receive a changing voltage ELVDDL+$V_{th,T1}$+ΔV according to voltage regulations of the previous data voltages. The leakage current of the first transistor T1 may occur by the changing voltage applied to the anode electrode.

According to the exemplary embodiment, the middle voltage ELVDDM that is lower than the high voltage ELVDDH and higher than the low voltage ELVDDL is applied the first transistor T1. Thus, a voltage Vds between the source and the drain of the first transistor T1 may decrease to decrease the leakage current of the first transistor T1.

Figure 12:
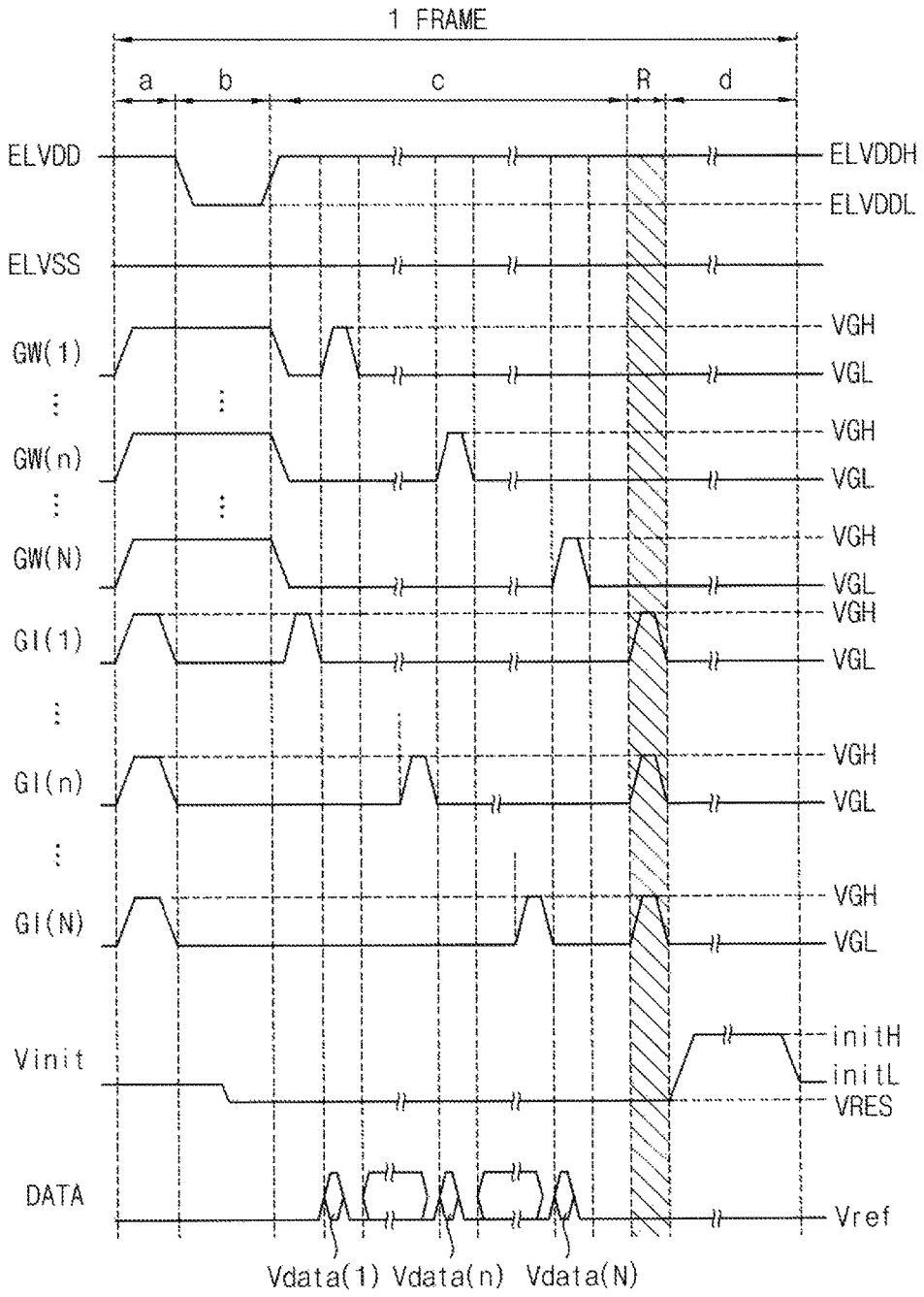
FIG. 12 is a timing chart illustrating a plurality of input signals of a display apparatus according to an exemplary embodiment.
Figure 13:
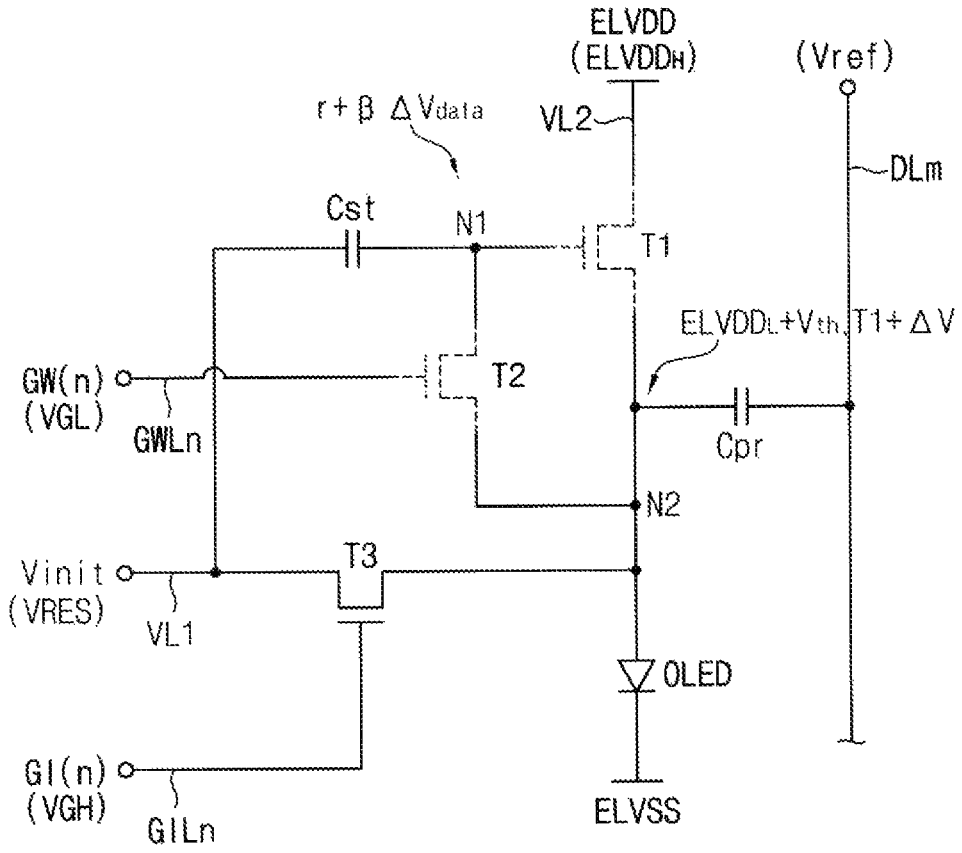
FIG. 13 is a conceptual diagram illustrating a method of driving the pixel circuit according to an exemplary embodiment.

FIG. 12 is a timing chart illustrating a plurality of input signals of a display apparatus according to an exemplary embodiment. FIG. 13 is a conceptual diagram illustrating a method of driving the pixel circuit according to an exemplary embodiment.

According to the exemplary embodiment, the method of driving the pixel circuit PC in comparison with the method of driving the pixel circuit PC according to the previous exemplary embodiment may include a second reset period 'R' between the third period 'c' and the fourth period 'd'. Hereinafter, the same reference numerals are used to refer to the same or like parts as those described in the previous exemplary embodiments, and the same detailed explanations may be simplified or omitted.

Referring to FIGS. 12 and 13, the third period c may include a first holding period c1, a first reset period c2, a writing period c3, and a second holding period c4. The method of driving the pixel circuit PC in the third period c may be the same as those described in the previous exemplary embodiment.

According to the exemplary embodiment, the method of driving the pixel circuit PC may further include the second reset period R between the third period c and the fourth period d.

During the second reset period R, the first voltage line VL1 is configured to receive the reset voltage VRES, the n-th gate line GWLn is configured to receive the low voltage VGL of the n-th gate signal GW(n), and the n-th scan line GILn is configured to receive the high voltage VGH of the n-th scan signal GI(n).

According to the exemplary embodiment, during the second reset period R, the plurality of scan lines GIL1, . . . , GILn, . . . , GILN may simultaneously receive the high voltages VGH of the plurality of scan signals GI(1), . . . , GI(n), . . . , GI(N).

The first and second transistors T1 and T2 are turned off, and the third transistor T3 is turned on in response to the high voltage VGH of the n-th scan signal GI(n).

The reset voltage VRES that is applied to the first voltage line VL1 is applied to the second node N2 through the third transistor T3. The reset voltage VRES may be a sum voltage of the low voltage ELVDDL of the first power source signal ELVDD and an average threshold voltage of the plurality of first transistors T1.

Thus, during the second reset period R, the anode electrode of the organic light emitting diode OLED may be reset to the reset voltage VRES.

During the fourth period d after the second reset period R, the first transistor T1 is turned on and thus, a driving current ID corresponding to the data voltage may flow through the organic light emitting diode OLED, and the organic light emitting diode OLED may emit the light.

According to the exemplary embodiment, the anode electrode of the organic light emitting diode OLED may be reset to the reset voltage VRES before the organic light emitting diode emits the light by the driving current corresponding to the data voltage. Thus, the display quality of the display part may be improved.

According to the exemplary embodiments, in the pixel circuit including three transistors and two capacitors that drive the organic light emitting diode, a voltage applied to the anode electrode of the organic light emitting diode that may change due to leakage currents is reset to the reset voltage and thus, display defects may be decreased or eliminated.

The present disclosure may be applied to a display device and an electronic device having the display device. For example, the present disclosure may be applied to a computer monitor, a laptop, a digital camera, a cellular phone, a smart phone, a smart pad, a television, a personal digital assistant (PDA), a portable multimedia player (PMP), a MP3 player, a navigation system, a game console, a video phone, etc.

The foregoing is illustrative of the present disclosure and is not to be construed as limiting thereof. Although a few exemplary embodiments of the present disclosure have been described, those skilled in the art will readily appreciate that various modifications are possible in the exemplary embodiments without materially departing from the novel teachings and advantages of the present disclosure. Accordingly, such modifications are intended to be included within the scope of the present disclosure. Therefore, it is to be understood that the foregoing is illustrative of the present disclosure and is not to be construed as limited to the specific exemplary embodiments disclosed, and that modifications to the disclosed exemplary embodiments, as well as other exemplary embodiments, are intended to be included within the scope of the present disclosure. The inventive concept of the present disclosure is defined by the following claims, with equivalents of the claims to be included therein.

What is claimed is:

1. A display apparatus comprising:

a gate driver;

a scan driver; and a display part comprising a plurality of pixels, each pixel including a first transistor, a second transistor, a third transistor, a first capacitor, a second capacitor, and an organic light emitting diode, wherein:

the first capacitor is connected between a first voltage line receiving a driving signal and a first node, the first transistor comprises a control electrode connected to the first node, a first electrode connected to a second voltage line receiving a first power source signal, and a second electrode connected to a second node, the organic light emitting diode comprises an anode electrode connected to the second node and a cathode electrode receiving a second power source signal, the second capacitor is connected between an m-th data line and the second node, the second transistor comprises a control electrode connected to an n-th gate line, a first electrode connected to the first node, and a second electrode connected to the second node, the third transistor comprises a control electrode connected to an n-th scan line, a first electrode connected to the first voltage line, and a second electrode connected to the second node, the gate driver is configured to provide a plurality of gate lines in the display part with a gate signal including a first level voltage and a second level voltage, and the gate driver is configured to provide the n-th gate line with the first level voltage of the gate signal during an n-th horizontal period of a frame, and the scan driver is configured to provide a plurality of scan lines in the display part with a scan signal including a first level voltage and a second level voltage, and the scan driver is configured to provide the n-th scan line with the first level voltage of the scan signal during a first reset period of the frame prior to the n-th horizontal period of the frame.

2. The display apparatus of claim 1, wherein during a first period of the frame, the first voltage line is configured to receive a second level voltage of the driving signal, the second voltage line is configured to receive a first level voltage of the first power source signal, the plurality of gate lines is configured to receive the first level voltage of the gate signal turning on the second transistor of the plurality of pixels, simultaneously, and the plurality of scan lines is configured to receive the first level voltage of the scan signal turning on the third transistor of the plurality of pixels, simultaneously.

3. The display apparatus of claim 2, wherein during a second period of the frame, the first voltage line is configured to receive the second level voltage of the driving signal during an early part of the second period and to receive a reset voltage that is different from the second level voltage of the driving signal during a latter part of the second period, the second voltage line is configured to receive a second level voltage of the first power source signal, the plurality of gate lines is configured to receive the first level voltage of the gate signal turning on the second transistor of the plurality of pixels, simultaneously, and the plurality of scan lines is configured to receive the second level voltage of the scan signal turning off the third transistor of the plurality of pixels, simultaneously.

4. The display apparatus of claim 3, wherein the second level voltage of the first power source signal is lower than the second level voltage of the driving signal.

5. The display apparatus of claim 3, wherein a third period of the frame comprises the first reset period in which the first voltage line is configured to receive the reset voltage, the n-th scan line is configured to receive the first level voltage of the scan signal, and the n-th gate line is configured to receive the second level voltage of the gate signal turning off the second transistor.

6. The display apparatus of claim 5, wherein the first reset period comprises at least one horizontal period.

7. The display apparatus of claim 5, wherein the third period of the frame comprises a first holding period prior to the first reset period in which the first voltage line is configured to receive the reset voltage, the n-th scan line is configured to receive the second level voltage of the scan signal, and the n-th gate line is configured to receive the second level voltage of the gate signal.

8. The display apparatus of claim 7, wherein the third period of the frame further comprises a writing period corresponding to the n-th horizontal period after the first reset period in which the first voltage line is configured to receive the reset voltage, the n-th scan line is configured to receive the second level voltage of the scan signal, the n-th gate line is configured to receive the first level voltage of the gate signal, and the m-th data line is configured to receive a data voltage.

9. The display apparatus of claim 8, wherein during the n-th horizontal period, the first and second capacitors are connected to each other in series, the data voltage is divided by the first and second capacitors, and a divided data voltage is applied to the first node.

10. The display apparatus of claim 8, wherein the third period of the frame further comprises a second holding period placed after the writing period in which the first voltage line is configured to receive the reset voltage, the n-th scan line is configured to receive the second level voltage of the scan signal, and the n-th gate line is configured to receive the second level voltage of the gate signal.

11. The display apparatus of claim 10, wherein during the third period, the second voltage line is configured to receive the first level voltage of the first power source signal.

12. The display apparatus of claim 10, wherein during a fourth period of the frame, the first voltage line is configured to receive a first level voltage of the driving signal that is higher than the second level voltage of the driving signal, the second voltage line is configured to receive the first level voltage of the first power source signal, the plurality of gate lines is configured to receive the second level voltage of the gate signal, simultaneously, and the plurality of scan lines is configured to receive the second level voltage of the scan signal, simultaneously, and wherein the first transistor is turned on by a difference voltage between the first and second level voltages of the driving signal, and a driving current corresponding to a data voltage applied to the first node flows in the organic light emitting diode.

13. The display apparatus of claim 12, wherein the frame further comprises a second reset period placed between the second holding period and the fourth period in which the first voltage line is configured to receive the reset voltage, the plurality of scan lines corresponding to a plurality of horizontal lines is configured to receive the first level voltage of the scan signal, simultaneously, and the plurality of gate signals is configured to receive the second level voltage of the gate signal, simultaneously.

14. The display apparatus of claim 10, wherein during the third period of the frame, the second voltage line is configured to receive a middle voltage between the first and second level voltages of the first power source signal.

15. A method of driving a display apparatus that comprises a pixel circuit driving an organic light emitting diode, the method comprising:

applying a second level voltage of a driving signal to a first voltage line to initialize an anode electrode of the organic light emitting diode that is connected to a second electrode of a first transistor;

applying a second level voltage of a first power source signal to a first electrode of the first transistor to render the first transistor to be diode-connected;

resetting the anode electrode of the organic light emitting diode using a reset voltage applied to the first voltage line during at least one horizontal period prior to an n-th horizontal period;

applying a data voltage divided by a first capacitor and a second capacitor to a control electrode of the first transistor during the n-th horizontal period; and driving the organic light emitting diode to emit light based on the data voltage applied to the control electrode of the first transistor in response to a first level voltage of the driving signal applied to the first voltage line.

16. The method of claim 15, wherein the driving the organic light emitting diode comprises applying a first level voltage of the first power source signal to the first electrode of the first transistor.

17. The method of claim 16, wherein each of the resetting the anode electrode and applying the data voltage comprises applying the first level voltage of the first power source signal to the first electrode of the first transistor.

18. The method of claim 16, wherein each of the resetting the anode electrode and applying the data voltage comprises applying a middle voltage between the first and second level voltages of the first power source signal to the first electrode of the first transistor.

19. The method of claim 15, wherein the reset voltage corresponds to a sum voltage of the second level voltage of the first power source signal and an average threshold voltage of a plurality of first transistors in a plurality of pixel circuits.

20. The method of claim 15, further comprising:

resetting the anode electrode of the organic light emitting diode using the reset voltage applied to the first voltage line between the applying the data voltage and the driving the organic light emitting diode.

* * * * *